US005216885A

United States Patent [19]

Taniguchi et al.

[11] Patent Number: 5,216,885

[45] Date of Patent: Jun. 8, 1993

[54] COMBUSTOR FOR BURNING A PREMIXED GAS

[75] Inventors: Masayuki Taniguchi; Yasuo Yoshii, both of Katsuta; Tadayoshi Murakami, Hitachi; Shigeru Azuhata, Hitachi; Norio Arashi, Hitachi; Kenichi Sohma, Ibaraki; Michio Kuroda, Hitachi; Hironobu Kobayashi, Katsuta; Yoji Ishibashi, Hitachi, all of Japan

[73] Assignee: Hitachi, Ltd., Tokyo, Japan

[21] Appl. No.: 495,907

[22] Filed: Mar. 20, 1990

[30] Foreign Application Priority Data

Mar. 20, 1989 [JP] Japan ..... 1-66232
Sep. 21, 1989 [JP] Japan ..... 1-245534

[51] Int. Cl.[5] ..... F02C 1/02
[52] U.S. Cl. ..... 60/737; 60/747
[58] Field of Search ..... 60/737, 746, 747, 749

[56] References Cited

U.S. PATENT DOCUMENTS

| | | | |
|---|---|---|---|
| 2,806,517 | 9/1957 | te Muyl | 158/4 |
| 3,800,527 | 4/1974 | Marshall et al. | 60/749 |
| 3,922,137 | 11/1975 | Peczeli et al. | 431/183 |
| 4,052,844 | 10/1977 | Carvel et al. | 60/749 |
| 4,199,934 | 4/1980 | Meyer | 60/39.23 |
| 4,246,757 | 1/1981 | Heberling | 60/737 |
| 4,373,325 | 2/1983 | Shekleton | 60/39.06 |
| 4,470,262 | 9/1984 | Shekleton | 60/737 |

FOREIGN PATENT DOCUMENTS

| | | |
|---|---|---|
| 192266 | 8/1986 | European Pat. Off. . |
| 281961 | 9/1988 | European Pat. Off. . |

*Primary Examiner*—Richard A. Bertsch
*Assistant Examiner*—Charles G. Freay
*Attorney, Agent, or Firm*—Antonelli, Terry, Stout & Kraus

[57] ABSTRACT

Method of burning a premixed gas and a combustor for practicing the method. A jet of the premixed gas is burnt from an inside to an outside of the jet to form a premix flame. A burned gas is mixed into the premixed gas from the outside of the jet. The burned gas is produced when premixed gas is burned.

31 Claims, 23 Drawing Sheets

COMBUSTOR FOR BURNING A PREMIXED GAS

BACKGROUND OF THE INVENTION

The present invention relates to a method of burning a premixed gas and a combustor for practicing the method and, more particularly, to a gas turbine combustor and a burner for practicing the method.

Generally, NOx which is produced during combustion includes fuel NOx and thermal NOx with the former being produced from nitric compounds in the fuel and the latter from nitrogen in the air.

To reduce emission, fuel NOx is reduced to $N_2$ and $O_2$ by forming a reduction zone in the combustion zone, but essentially it is most effective to reduce nitrogen in the fuel, that is, to modify the quality of the fuel.

There are water injection method, gas recirculating burning method, fuel dilution combustion method or a like method for reducing thermal NOx. These methods achieve reduction of thermal NOx by reducing the temperature of the flame but they are liable to deteriorate stability of the flame.

As a known combustion method in a combustor, so called diffusion combustion has been widely adopted in which fuel and air were injected from respective nozzles but recently, premix combustion in which fuel and air are premixed and then injected from the same nozzle are being brought to use.

Premix combustion has the following two main advantages:

One advantage is that premix combustion reduces the reaction zone of combustion. That is, the gas ejected from the nozzle is a premixed gas consisting of fuel and air. This obviates any zone to produce a premixed gas downstream of the fuel nozzle as in the prior art, and hence it is possible to shorten the flame and to provide high load combustion.

The other advantage is that premix combustion is capable of reducing thermal NOx. In diffusion combustion in which fuel and air are injected into a combustion chamber from different nozzles, a zone of which air ratio (theoretical mixing ratio) is close to 1 is inevitably produced in the mixing process of the fuel and air in the combustion chamber event if the fuel is burned out in a diluted condition. Thus, it is well known that reduction of NOx is difficult in diffusion combustion. On the contrary, in fuel dilution premix combustion method in which fuel and excess air is premixed and then burned, the fuel is burned in a dilute combustion condition in the overall combustion zone, and hence it is easy to reduce NOx.

Such a dilution premix combustion method is adopted in a combustor of a gas turbine disclosed in Japanese Patent (examined) Publication NO. 62 (1987)-35016, for example.

Although dilution premix combustion reduces NOx at relatively low flame temperature due to combustion in excess air, it is inferior in stability of the premix flame.

To improve the stability of the premix flame, it is necessary to form the flame in the vicinity of a theoretical mixing ration but combustion in the vicinity of the theoretical mixing ratio produces a lot of NOx.

Thus, the condition to facilitate forming of stable flame and the condition to suppress production of NOx are in conflict with each other. This requires flame stabilization to form stable flame even in an excess air ratio condition or combustion technology which enables NOx to be reduced in combustion in the vicinity of a theoretical mixing ratio.

The known art of stabilizing premix flame includes combustors disclosed in U.S. Pat. Nos. 4,051,670 and 4,150,539, for example.

The combustor of the former patent is provided with a swirling mechanism to swirl a gas mixture of air and fuel in the combustion chamber, and the combustor further includes an pressure reducing mechanism to reducing pressure in a portion of the zone in which the swirl is formed. The ignition of the fuel is positively achieved by introducing a hot combustion gas into the swirl of the mixture gas, so that the flame is stabilized.

The combustor of the latter includes a baffle arranged at an exhaust nozzle of a mixture gas of air and fuel. A hot combustion gas formed downstream of the baffle serves as an ignition source and hence stabilizes the flame.

Various other attempts to stabilize flame have proposed as described in, for example: Japanese Patent (unexamined) Publication No. 59 (1984)-74,406 utilizing a pilot flame; and Japanese Patent (unexamined) Publication No. 64 (1989)-54,122 forming a swirl.

In these last-mentioned publications, only a small mixing zone to mix the combustion gas and the premixed gas is formed.

When dilution premix combustion is conducted according the flame stabilizing methods described above, both stabilization of premix flame and some reduction of NOx are achieved.

However, recently emission standards against NOx which causes photochemical smogs is becoming stricter, and hence it is desired to further reduce NOx.

SUMMARY OF THE INVENTION

In view of these drawbacks of the prior art, it is an object of the present invention to provide a combustor which ensures stable flame to be produced and NOx to be fairly reduced.

With this and other objects in view, one aspect of the present invention is directed to a combustor of the type which includes a first nozzle adapted to eject a jet of a premixed gas containing a fuel and air, comprising premixed gas burning means for burning the jet of the premixed gas from an inside to an outside of the jet, and gas mixing means for mixing a combustion gas with the jet of the premixed gas outwardly of the jet.

Another aspect of the present invention is directed to a gas turbine combustor comprising a first annular nozzle, having an exhaust port, for ejecting an annular jet of a first premixed gas through the exhaust port, the first premixed gas containing a primary fuel and air, annular baffling means for baffling the annular first premixed gas jet to bifurcate the first premixed gas set into two concentric annular jets, a primary combustion chamber communicated to the exhaust port of the first nozzle, with the primary combustion chamber sharply enlarging a cross-sectional area thereof from the exhaust port of the first nozzle. A second annular nozzle, including an exhaust port, ejects an annular jet of a secondary premixed gas, through the exhaust port thereof, with the second annular nozzle being arranged downstream of the primary combustion chamber and having an inner diameter larger than an outer diameter of the first annular nozzle, and with the secondary premixed gas containing a second fuel and air. A secondary combustion chamber is adapted to receive the secondary premixed gas injected thereinto from the secondary annular nozzle.

According to still another aspect of the present invention, there is provided a combustion method for burning a jet of a premixed gas of a fuel and air. The combustion method comprising the steps of burning the jet of the premixed gas from an inside to an outside of the jet to form a first flame, and mixing a burned gas into the premixed gas from the outside of the jet, with the burned gas being produced in the burning step.

Another aspect of the present invention is directed to a burner of the type which includes a nozzle for ejecting a jet of a premixed gas through an exhaust port thereof, with the premixed gas containing a fuel and air. The burner comprises baffle means, arranged downstream of the exhaust port of the nozzle, for baffling the jet of the premixed gas for forming a recirculating flow of a burned gas downstream of thereof, with the burned gas being produced by burning the premix gas, and burned gas mixing means for mixing the burned gas into the premixed gas set from an outside of the premixed gas jet.

DETAILED DESCRIPTION OF PREFERRED EMBODIMENTS

Figure 1:
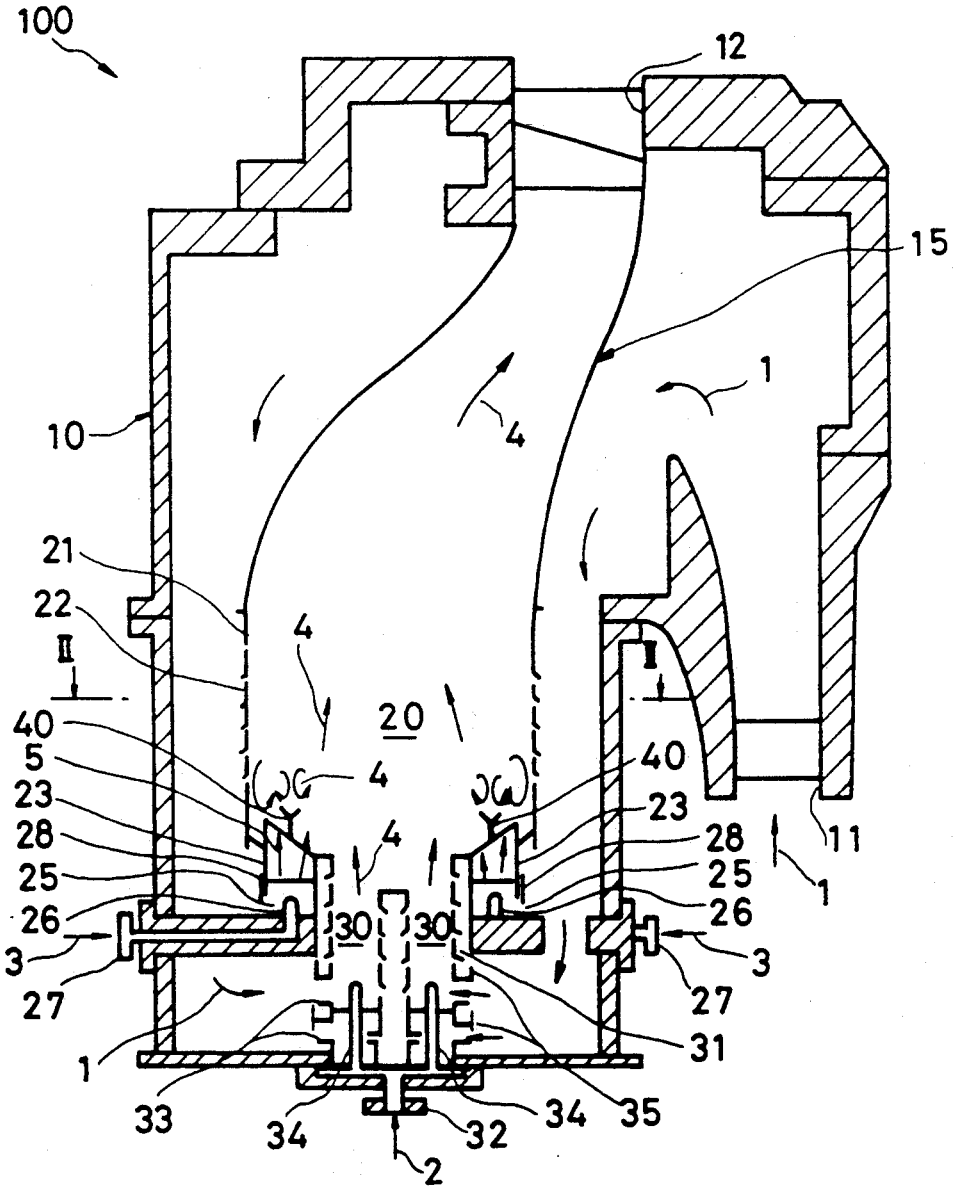
FIG. 1 is a sectional view of a gas turbine combustor of the present invention.

Referring now to the drawings, embodiments of the present invention will be described. Corresponding parts are designated by like reference numerals and descriptions thereof are omitted after once given.

A first embodiment of the present invention will be described with reference to FIGS. 1 to 6. A combustor 100 for a gas turbine is, as shown in FIG. 4, communicated at the air intake to an air compressor 301 in which combustion air 1 is compressed and sent into the combustor 100, and the combustor 100 is connected at the exhaust to a gas turbine 303 which is driven by combustion gas 4 produced in the combustor 100. The gas turbine 303 is connected to a generator 304.

Figure 2:
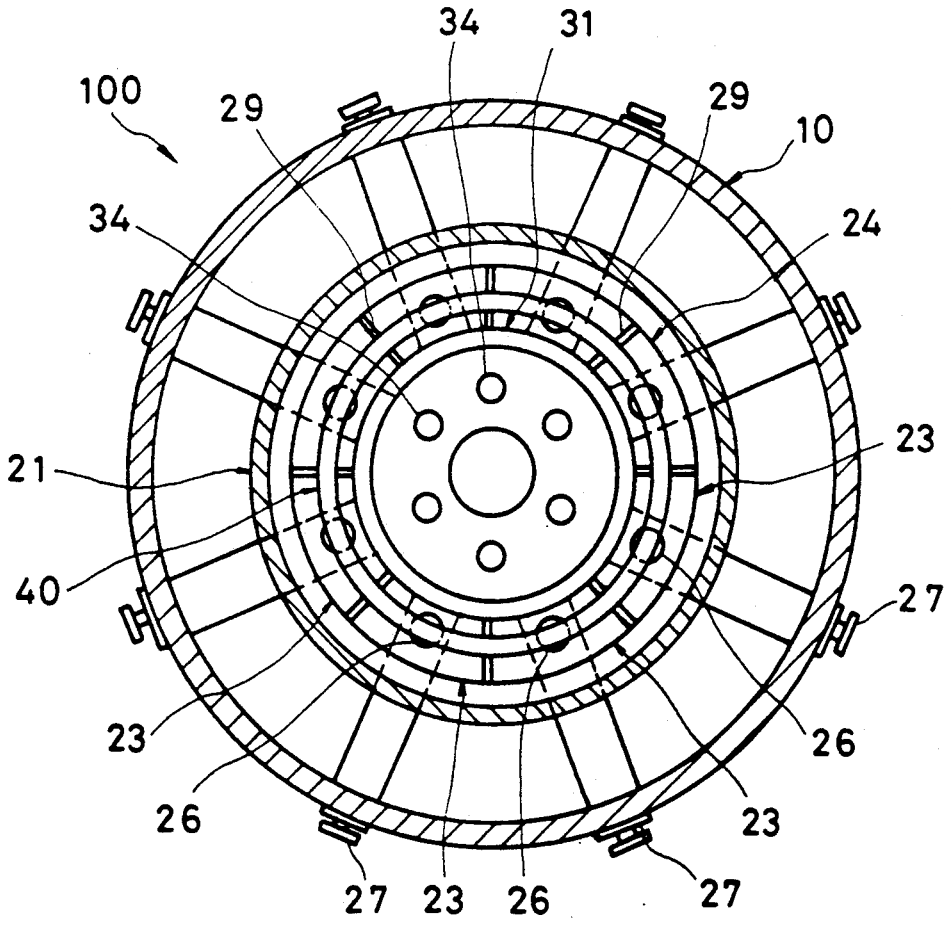
FIG. 2 is a view taken along the line II—II in FIG. 1.
Figure 3:
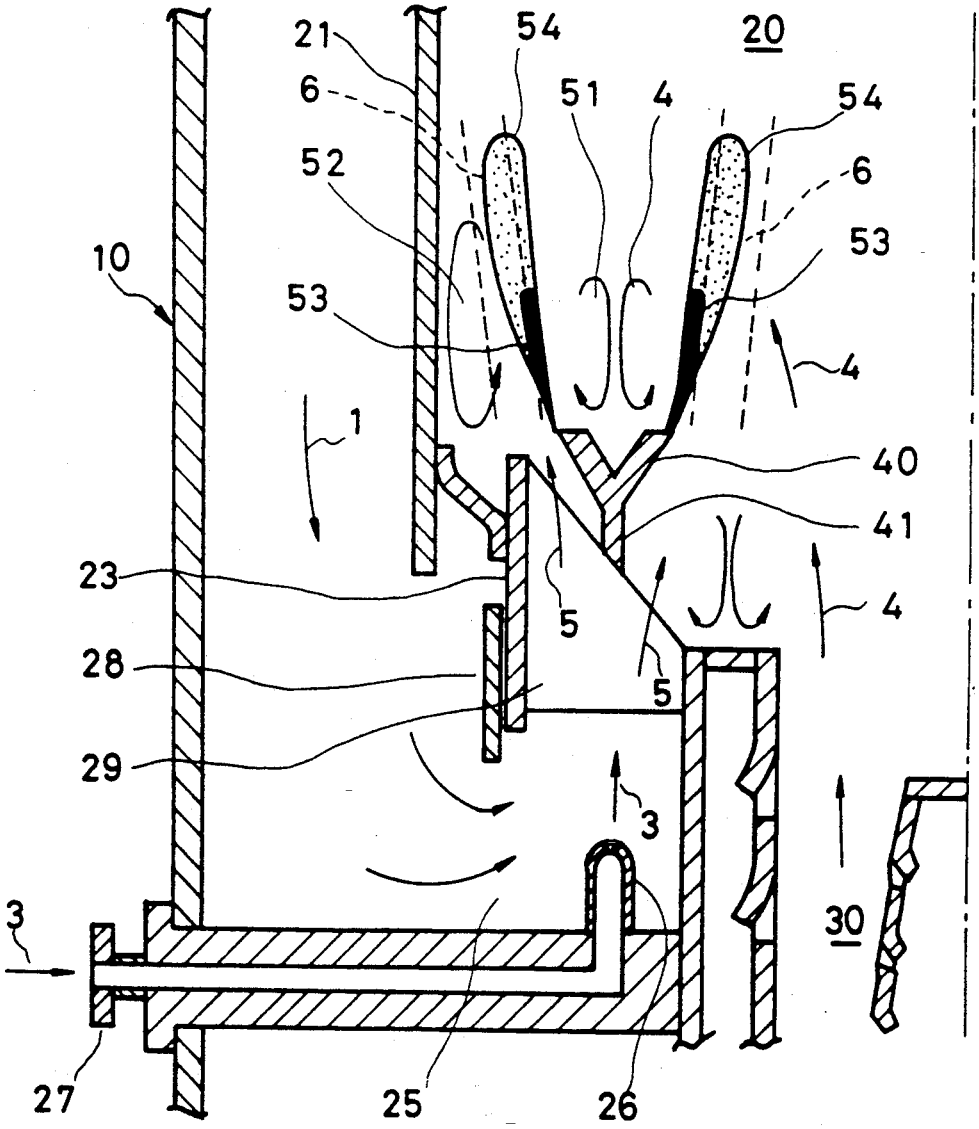
FIG. 3 is a sectional view of an essential portion of the gas turbine combustor of FIG. 1.
Figure 4:
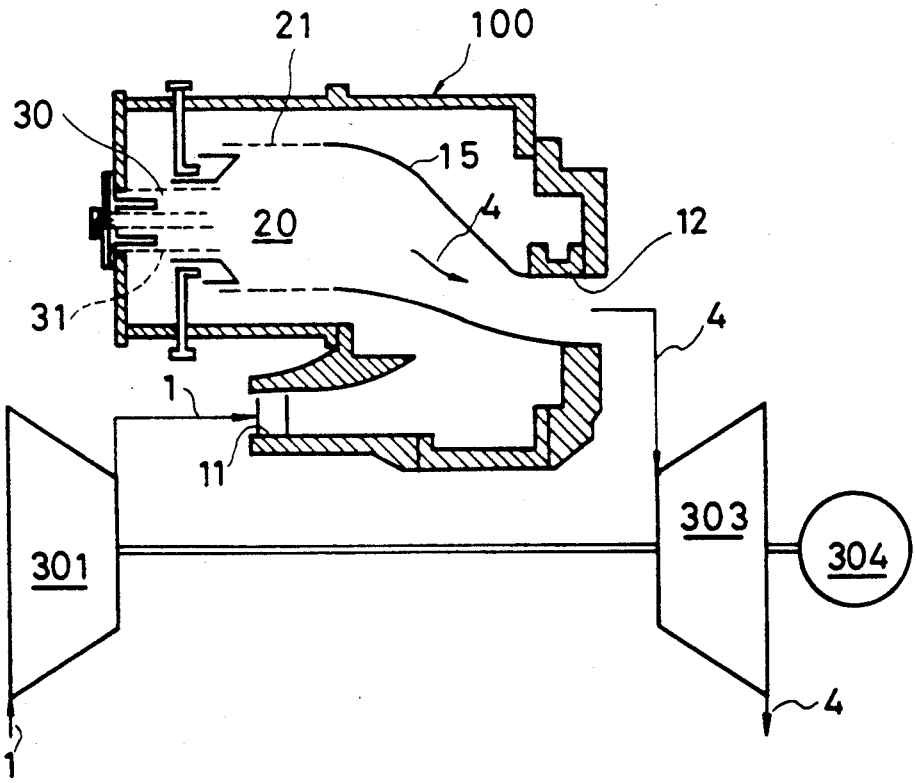
FIG. 4 is a schematic flow diagram of a gas turbine power generating plant using the gas turbine combustor in FIG. 1.

As illustrated in FIGS. 1 to 3, the combustor 100 includes a combustor casing 10. The combustor casing 100 is provided with the air intake 11 to take in combustion air 1 from the air compressor 301 and the combustion gas exhaust 12 which discharges combustion gas 4 produced by combustion. Within the combustor casing 10, there are provided a cylindrical primary combustion inner housing 31, which defines a primary combustion chamber 30, and a secondary combustion inner housing 21 which defines secondary combustion chamber 20.

The primary combustion inner housing 31 is mounted on an inner surface of the combustor casing 10, with the inner surface opposing the combustion gas exhaust port 12. As shown in FIG. 2, a plurality of primary fuel nozzles 34, 34, . . . are provided within the primary combustion inner housing 31 at equal angular intervals around the axis of the inner housing 31. The primary fuel nozzles 34 eject a primary fuel 2. The primary fuel nozzles 34 area communicated to a primary fuel receiving nozzle 32 for receiving the primary fuel 1. The primary combustion inner housing 31 has primary air supply openings 33, 33 formed through its circumferential wall so as to flow combustion air 1 into it. Primary air regulating valves 35 are provided at the circumferential wall of the inner housing 31 for regulating the amount of combustion air 1 which flows into the inner housing 31.

The secondary combustion inner housing 21 is arranged downstream of the primary combustion inner housing 31. The secondary combustion inner housing 21 is provided in its circumferential wall with cooling air ports 22 to cool itself. A plurality of premix flame forming nozzle 23, 23, . . . are arranged at an upstream end of the secondary combustion inner housing 21 at predetermined angular intervals around the axis of the secondary combustion inner housing 21 to form a premix flame forming nozzle group 23. The premix flame forming nozzles 23, 23, . . . eject a premixed gas 5 consisting of combustion air 1 and secondary fuel 3. Arranged around the upstream ends of the premix flame forming nozzles 23, 23, . . . are secondary air intake ports 25, 25, . . . and secondary fuel nozzles 26, 26, . . . , with the former allowing combustion air 1 to flow into the premix flame forming nozzles 23, 23, . . . and the latter ejecting secondary fuel 3. The secondary fuel nozzles 26, 26, . . . . are communicated to respective secondary fuel receiving nozzles 27, 27, . . . to receive secondary fuel 3. Secondary air regulating valves 28, 28, . . . are provided to respective secondary air intake ports 25, 25, . . . for regulating the amount of combustion air 1 which flows into secondary air intake ports 25.

The outer diameter of the overall premix flame forming nozzle group 23 is designed to be smaller than the inner diameter of the secondary combustion inner housing 21. The secondary combustion chamber 20 is formed so that the cross-sectional area thereof becomes sharply enlarged at outlets of the premix flame forming nozzles 23.

In the vicinity of the premix flame forming nozzles 23, there is provided a baffle 40 to recirculate burned gas 4 which is produced by combustion of premixed gas 5. The baffle 40 has, as shown in FIGS. 2 and 3, an annular shape with a V-shaped cross-section. The baffle 40 is arranged around the premix flame forming nozzle group 23. The radial width of the baffle 40 is smaller than the radial width of the premix flame forming nozzle group 23. The V-shape cross-sectioned baffle 40 is arranged to direct its apex portion upstream. A supporting member 41 is provided at the apex of the baffle 40 to support the latter. The supporting member 41 is mounted on partitions 29 which are interposed between adjacent premix flame forming nozzles 23.

A transition piece 15 is connected to the lower end of the secondary combustion inner housing 21 to guide burned gas 4 to the burnt gas exhaust port 12 of the combustor casing 10.

Combustion air which has been pressurized in the air compressor 301 flows through the air intake 11 into the combustor casing 10 where combustion air 1 flows through an annular path defined between the combustor casing 10 and the transition piece 15, and then through an annular path formed between the combustor casing 10 and the secondary combustion inner housing 21. Part of the combustion air 1 flows into the primary combustion inner housing 31 through primary air intake ports 33 while another part thereof is supplied to the secondary combustion inner housing 21 through secondary air intake ports 25. Part of combustion air 1 flows through cooling air ports 22 into the secondary combustion inner housing 21 to cool the wall of the latter.

Primary fuel 2 is fed through the primary fuel receiving nozzle 32 to the primary fuel nozzles 34 from which it is injected into the primary combustion chamber 30. Secondary fuel 3 flows through the secondary fuel receiving nozzles 27 into corresponding secondary fuel nozzles 26, which eject it into respective premix flame forming nozzles 23.

In this embodiment, use may be made of liquefied natural gas as the fuel 2 and 3. A demand for liquefied natural gas as clean energy has recently increased since it is contains little sulfur content and nitric compounds and hence produces little SOx and fuel NOx.

The primary fuel 2 which is injected from the primary fuel nozzles 34 reacts with combustion air 1 to form a diffusion flame within the primary combustion chamber 30.

The secondary fuel 3 which issues from the secondary fuel nozzles 26 is mixed with combustion air 1 within premix flame forming nozzles 23 to form premixed gas 5, and the premixed gas 5 is injected into the secondary combustion chamber 20. The premixed gas 5 which issues into the secondary combustion chamber 20 branches off in the presence of the baffle 40. A primary recirculating zone 51 is formed downstream of the baffle 40, recirculating a gas. Also around the outer circumference of the baffle 40, that is, around the inner circumference of the secondary combustion inner housing 21, there is formed a secondary recirculating zone 52 recirculating a gas. These streams of recirculating flow are formed by diverging premixed gas 5 radially outwards in a rapid manner. A burned gas 4 at about 2000° C. which has been produced by combustion of premixed gas 5 flows into the primary recirculating zone 51. For this reason, the primary recirculating zone 51 exceeds an ignition temperature, 700°–800° C., of premixed gas 5 to become a hot zone above 1500° C., and hence premixed gas 5 which comes close to the primary recirculating zone 51 is positively ignited, thereby forming a relatively intense combustion zone 53. Thus, the ignition source of burned gas 4 stabilizes the premix flame formed within the secondary combustion chamber 20.

Burned gas 4 and premixed gas 5 flow into a secondary recirculating zone 52 which is formed around the outer periphery of the annular baffle 40. In the secondary recirculating zone 52, burned gas 4 and premixed gas 5 are mixed, forming combustion gas mixture 6. Also around the inner periphery of the annular baffle 40, premixed gas 5 and burned gas 4, produced in the primary combustion chamber 30, are mixed to produce combustion gas mixture 6 having a low oxygen partial pressure.

These combustion gas mixtures 6 are ignited by the flame of the relatively intense combustion zone 53, burning to form a less intense combustion zone 54 outside the combustion zone 53. In the less intense combustion zone 54, combustion gas mixture 6 having a low oxygen partial pressure burns, and hence the combustion temperature is relatively low and the amount of NOx produced in that zone is extremely small.

To form combustion gas mixture 6, it is necessary to propagate flame from the inside to the outside of the premixed gas 5 which is being injected from the premix flame forming nozzle 23. This is because if premixed gas 5 is ignited at the outside and flame propagates toward the inside, premixed gas 5 burns out before it is mixed with burned gas 4, and hence combustion gas mixture 6 is not produced.

It is to be noted that if secondary fuel 3, combustion air 1 and burned gas 4 are uniformly mixed and then ejected from the premix flame forming nozzles 23 to form flames, stable flames are not formed because only less intense combustion zone is formed.

As in this embodiment, the premix flame forming nozzles 23 are preferably arranged in the shape of a ring in the vicinity of the downstream end of the primary combustion chamber 30. With such an arrangement, premixed gas 5, ejected from the premix flame forming nozzles 23, is rapidly ignited by the heat of burned gas 4, the burned gas being exhausted from the diffusion flame which is produced in the primary combustion chamber 30. In this manner, the premix flames are more stabilized.

With respect to the radial width of the baffle 40, it is preferable that the width is smaller than the radial width of the exhaust ports of the premix flame forming nozzles 23 as in this embodiment. If on the contrary, the radial width of the baffle 40 is larger than that of the exhaust ports of the premix flame forming nozzles 23, the primary recirculating zone 51 becomes rather larger, so that premix flames are not sustained close to the baffle 40, thus deteriorating stability of the flames.

The burned gas 4 produced in the secondary combustion chamber 20 of the gas turbine combustor 100 is discharged from the burnt gas exhaust port 12, and is supplied to the gas turbine 303. In the gas turbine 303, the turbine is driven in the process of expansion of high temperature and high pressure burned gas 4. Motive power produced in the gas turbine 303 is transmitted to a generator 304 where power generation is carried out.

In present day gas turbine power plant, burned gas 4 which is discharged from the gas turbine 303 is often introduced into an exhaust heat recovering boiler, where heat energy recovered is reused as a heat source for generating steam. Denitration equipment is installed within the exhaust heat recovering boiler. The denitration equipment removes NOx in burned gas 4 by reacting ammonium with burned gas 4 on the surfaces of a solid catalyst. When the gas turbine combustor 100 of the present invention is used, the production of NOx is reduced, and hence the consumption of ammonium in the denitration equipment is reduced. The gas turbine combustor 100 can come up to the environmental quality standard of NOx without the denitration equipment depending on the mode of operation.

In this embodiment, partitions 29 are provided for forming a plurality of premix flame forming nozzles 23, 23, . . . , but partitions 29 are not necessarily used for forming premix flame forming nozzles 23 when the baffle 40 is supported on the other suitable manner. When premix flame forming nozzles become large 23 for a large-sized combustor, it is however preferable to provide partitions 29 to form premix flame forming nozzles 23 for sufficiently mixing primary fuel 2 and combustion air 1 and for preventing backfire.

Figure 5:
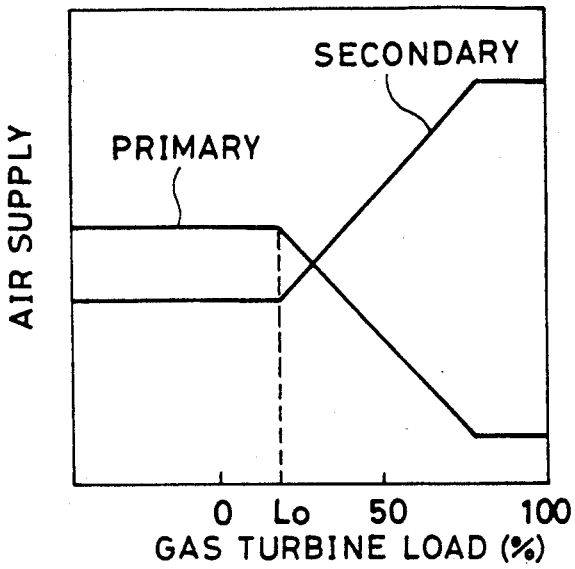
FIG. 5 is a graph illustrating the relationship between gas turbine load and air supply during operation of the gas turbine of FIG. 1.
Figure 6:
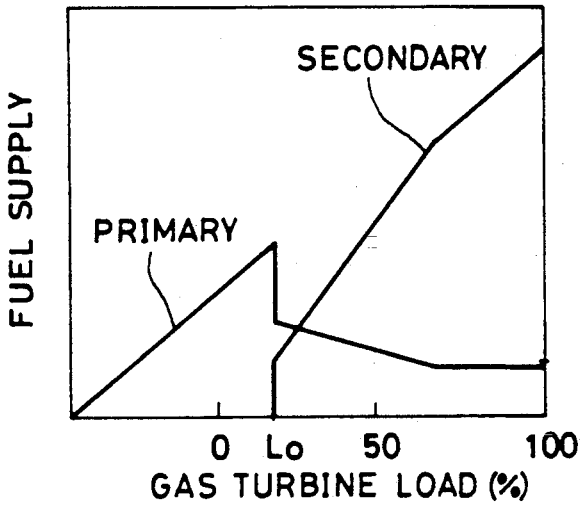
FIG. 6 is a graph illustrating the relationship between gas turbine load and fuel supply during operation of the gas turbine of FIG. 1.

With reference to FIGS. 5 and 6, when the gas turbine 303 is started, only primary fuel 2 is injected into the gas turbine combustor 100 as shown in FIG. 6, and diffusion flame is formed in the primary combustion chamber 30. When the load of the gas turbine 303 reaches a predetermined load Lo %, the supply of primary fuel 2 is reduced while, in response to this reduction, the supply of secondary fuel 3 is increased, and thereby premix flames are formed in the secondary combustion chamber 20. Until the load reaches from the predetermined load Lo % to 100% of a maximum load, the supply of secondary fuel 3 is increased to correspond to such a change of the load.

With respect to the air supply, as illustrated in FIG. 5, the supply of the primary air is reduced but the supply of the secondary air increases to correspond to a change in supply of each of both primary fuel 2 and secondary fuel 3.

In a combustor without any baffle 40, the stability of the premix flames formed in the secondary combustion chamber 20 are influenced by the amount of combustion and the air ratio of diffusion flame formed in the primary combustion chamber 30, and hence the ratio of the supply of primary fuel 2 to the supply of secondary fuel 3 is limited within a predetermined range. The combustor of this embodiment includes a stabilizing mechanism to stabilize premix flames independently, and thus the stabilizing mechanism enables setting of any ratio of the amount of primary fuel 2 over the amount of secondary fuel 3, thereby facilitating adjustment of the supply of fuels according to a load change. Moreover, the stabilizing mechanism allows a relatively large range of load change.

In the gas turbine combustor 100, the supply of primary fuel 2 may be discontinued after starting of the supply of secondary fuel 3 but primary fuel 2 may be always fed to the secondary combustion chamber 20 to sustain the diffusion flame, and thereby a quick response to a change of the load can be made.

Tests were conducted on various types of combustors, and the results thereof are illustrated in FIGS. 7 to 13. The principle of the stabilization of premix flamed and the effects of reduction of NOx will be described with reference to those figures. The tests used five types of test combustors.

Figure 7:
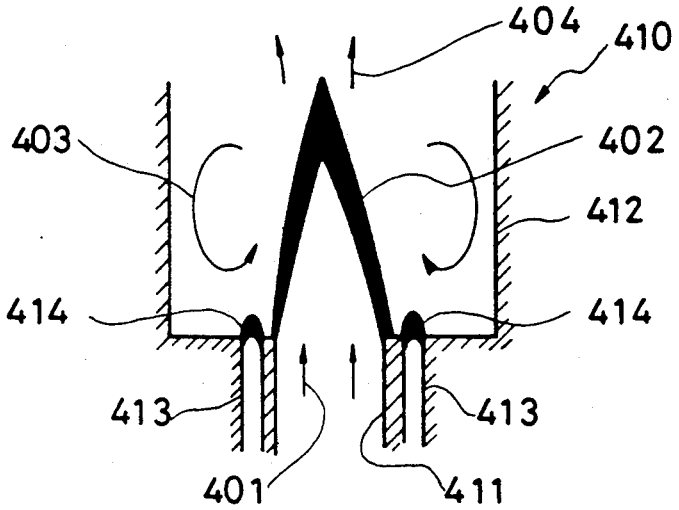
FIGS. 7 to 9 are sectional views of first to third combustors used in tests, respectively.

As shown in FIG. 7, the first test combustor 410 was provided with a premix flame forming nozzle 411, a combustion chamber 412 communicated to the premix flame forming nozzle 411, and pilot burners 413, 413, . . . arranged around the exhaust port of the premix flame forming nozzle 411. The combustion chamber 412 was formed to sharply enlarge the cross-sectional area of the path of premixed gas 401 when premixed gas 401 passes through the exhaust port of the premix flame forming nozzle 411. The flow rate of the injected gas through pilot burners 413 was set equal to or below about 1/1000 of the flow rate of the gas injected through the premix flame forming nozzles 411.

The pilot burners 413 formed pilot flames 414, which served as igniting sources to ignite premixed gas 401 being ejected from the premix flame forming nozzle 411. A premix flame 402 was conically formed from the exhaust port of the premix flame forming nozzle 411. An outer recirculating zone 403 was formed around the premix flame 402 by burnt gas 404.

In this combustion, pilot flames 414, as igniting sources, stabilized the premix flame 402. However, the mixing of the premixed gas 401 and recirculating streams of burnt gas 404, formed around the premix flame 402, could be hardly expected since the proximal end of the premix flame 402 was not separated from the outlet of the premix flame forming nozzle 411. Thus, there was little possibility of burning premixed gas 401 mixed with burnt gas 404. This first test combustor 410 could not considerably reduce the NOx concentration.

Figure 8:
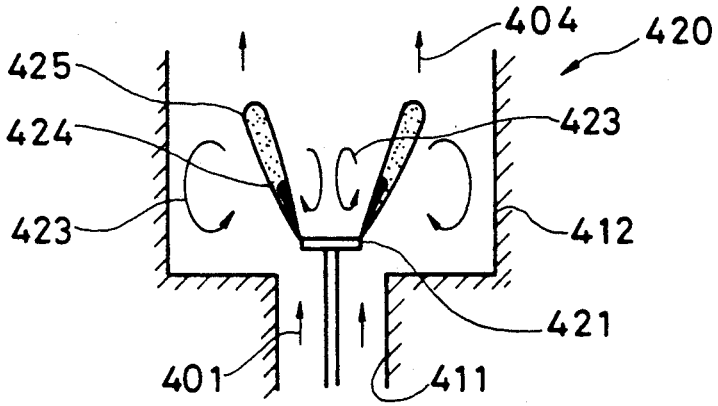

The second test combustor 420 was built according to the present invention. As illustrated in FIG. 8, the second test combustor 420 was provided with a premix flame forming nozzle 411, a combustion chamber 412 communicated to the outlet of the premix flame forming nozzle 411, and a disc shaped baffle 421 arranged close to the exhaust port of the premix flame forming nozzle 411. Also in this second test combustor 420, the combustion chamber 412 sharply enlarged the cross-sectional area of the path of premixed gas 401 from the exhaust port of the premix flame forming nozzle 411. Premixed gas 401 was ejected from the premix flame forming nozzle 411. An inner recirculating zone 422 was formed within the premixed gas jet in the presence of the baffle 421. In addition, an outer recirculating zone 423 was formed due to rapid enlargement of the cross-sectional area of the path of premixed gas 401 from the exhaust port of the premix flame forming nozzle 411.

The formation of each of the inner recirculating zone 422 and the outer recirculating zone 423 was confirmed by determining a temperature distribution, gas composition distribution, flow speed distribution, emitting spectrum distribution of OH radical, etc.

Hot burnt gas 404 flowed into the inner recirculating zone 422, and thereby a relatively intense combustion zone 424 was positively formed around the inner recirculating zone 422, so that the premix flame was stabilized.

The relatively intense combustion zone 424, that is, a high radical concentration zone was formed only within a specific narrow area. This means that the zone in which decomposition and oxidation of nitrogen in the combustion air were promoted was small and the production of thermal NOx was sustained.

Burnt gas 404 within the outer recirculating zone 423 and premixed gas 401, ejected from the premix flame forming nozzle 411, were mixed around the relatively intense combustion zone 424 to form combustion gas mixture. The combustion gas mixture was ignited by the flame which spread outwardly from the combustion zone 424 formed in the inside of the jet, and thus it burned to form a less intense combustion zone 425. Combustion progressed in a condition of low oxygen partial pressure, that is, a low radical concentration within the less intense combustion zone 425. This suppressed the production of NOx at a very low level.

To reduce NOx, the second test combustor 420 used burnt gas 404 which was produced by combustion of the premixed gas 401 itself, the premixed gas 401 ejected through the premix flame forming nozzle 411. However, a combustion gas which is produced by combustion of a fuel issued from other nozzles may be used.

Figure 9:
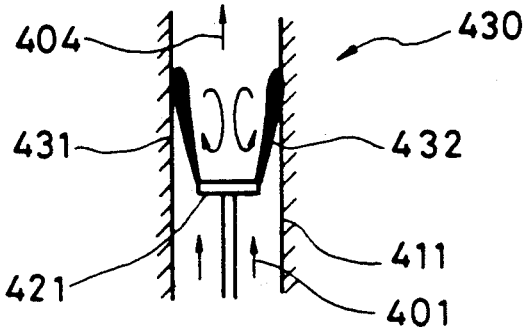

As shown in FIG. 9, a third test combustor 430 was provided with a premix flame forming nozzle 411, a combustion chamber 431, equal in diameter to the premix flame forming nozzle 411, and a disc-shaped baffle 421.

In combustion in the third test combustor 430, a premix flame 432 could be stabilized by the baffle 421 as in the second test combustor 420 but any outer recirculating zone could not be formed outside the premix flame 432 and the NOx concentration was not considerably reduced.

Figure 11:
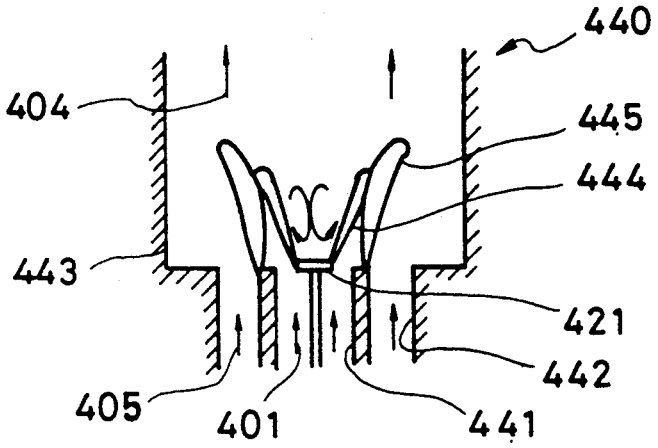
FIG. 11 is a partial diagrammatical sectional view of a fourth test combustor.

As shown in FIG. 11, a fourth test combustor 440 included a primary premix flame forming nozzle 441, around which were arranged secondary premix flame forming nozzles 442. The exhaust ports of the secondary premix flame forming nozzles 442 were arranged along a circle about the axis of the ejection port of the primary premix flame forming nozzle 441. A disc-shaped baffle 421 was provided in the vicinity of the ejection port of the primary premix flame forming nozzle 441. A combustion chamber 443 communicated at its upstream end to the primary premix flame forming nozzle 441 and the secondary premix flame forming nozzles 442, and thus the cross-sectional area of the path of premixed gas was sharply enlarged at the exhaust ports of the first test combustor 410 and the secondary premix flame forming nozzles 442.

Premixed gas 401 which was ejected from the primary premix flame forming nozzle 441 formed a stable primary premix flame 444 by the baffle 421. Premixed gas 405 which was ejected from the secondary premix flame forming nozzles 442 was ignited by the primary premix flame 444, thereby forming secondary premix flames 445. The secondary premix flames 445 were formed from positions at the exhaust ports of the secondary premix flame forming nozzles 442 close to the primary premix flame forming nozzle 441 to positions above the distal end of the primary premix flame 444.

In the fourth test combustor 440, premixed gas 401 which was ejected from the primary premix flame forming nozzle 441 burned out before it was mixed with burnt gas 404, and hence the fourth test combustor 440 could not considerably reduce NOx.

NOx exhaust characteristics of the test combustors described above are illustrated in FIGS. 10 and 12.

Figure 10:
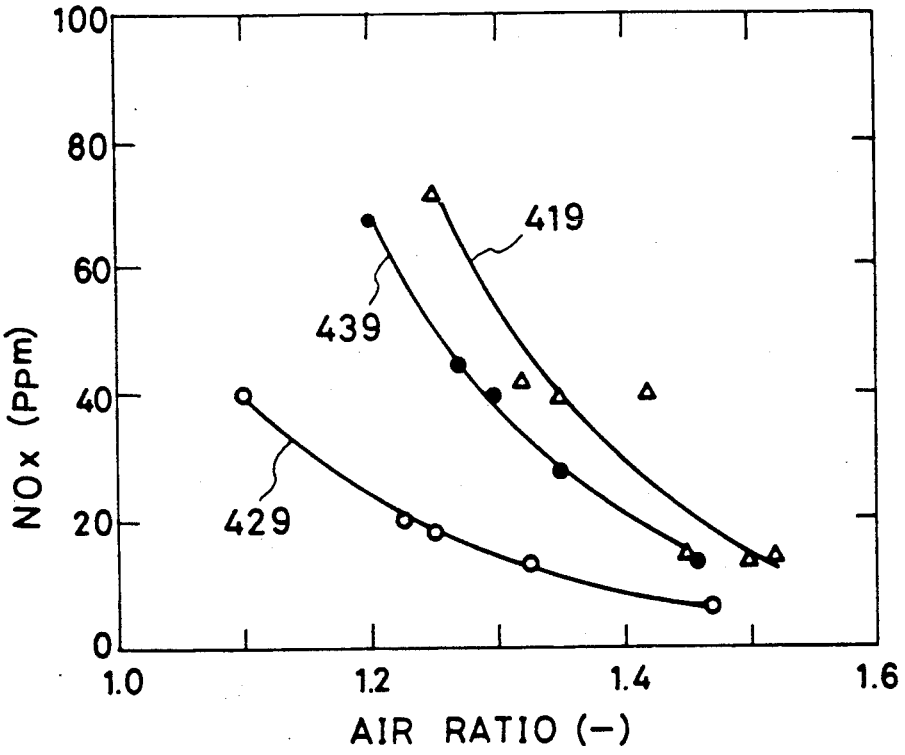
FIG. 10 is a graph showing NOx exhaust characteristics of the first and the second combustors.

NOx exhaust characteristic curves 419, 429 and 439 shown in FIG. 10 indicate those of the first test combustor 410, the second test combustor 420 and the third test combustor 430, respectively.

Figure 12:
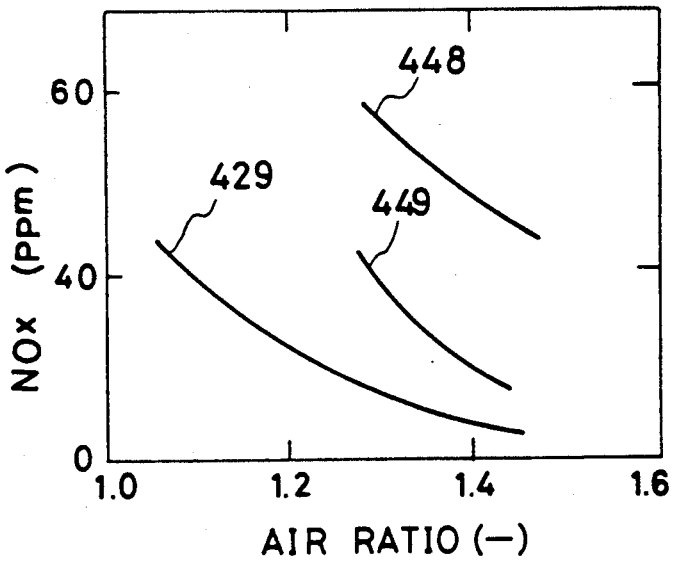
FIG. 12 is a graph showing NOx exhaust characteristics of the second and the fourth combustors.

The NOx exhaust characteristic curve 429 in FIG. 12 corresponds to the second test combustor 420. The curve 449 was obtained under a condition in which the production amount of NOx was minimum when in the fourth test combustor 440, the fuel to air ratio of premixed gas, which was ejected from each of the two types of nozzles 441 and 442, was changed. The curve 448 shows a characteristic of the fourth test combustor 440 in a condition in which the product amount of NOx was maximum.

From FIGS. 10 and 12, it is apparent that the second test combustor 420 of the present invention reduced the exhaust amount of NOx to or below $\frac{1}{3}$ of the other test combustors.

In view of NOx producing zones and the production speed, thermal NOx is classified into Serdwich NOx and prompt NOx.

Serdwich NOx is produced at a tail portion of flame with a relatively low speed, and this NOx is produced by oxidizing nitrogen in combustion air by oxygen.

Production of Serdwich NOx highly depends upon temperature, and the production amount increases as the temperature of flame is elevated. The temperature of flame and NOx concentration becomes maximum when the air ratio which is a ratio of a charge of air over an amount of air necessary to completely burn a fuel is in the vicinity of 1, that is, the fuel is burnt at close to the equivalent ratio.

Prompt NOx is inherent in hydrocarbon fuels and is produced by burning hydrocarbon fuels in or in the vicinity of a flame reaction zone at a relatively high speed. Prompt NOx is generated by decomposing and oxidizing nitrogen in fuel and air by hydrocarbon radical or other compounds with high reaction activity. The production of prompt NOx is relatively low in temperature dependency and is dominated by concentration of high reaction active radicals and the area of a zone in which high concentration of radicals exist.

Generally, the amount of production of prompt NOx increases as the amount of fuel increases over the amount of combustion air. As the amount of fuel decreases, the production amount of NOx according to Serdwich mechanism increases. From FIGS. 10 and 12, it is clear that the second test combustor 420 of the present invention reduced both kinds of NOx.

Thus, the combustor according to the present invention is capable of reducing NOx in combustion of fuel in both conditions with a large air ratio and with a small air ratio, and hence NOx can be sufficiently reduced without doing dilution premix combustion. It is possible to reduce NOx further by the use of dilution premix combustion method.

In the test of the second test combustor 420, it was confirmed that the exhaust density of NOx was about 60 ppm (converted in terms of 0% $O_2$) when complete combustion was carried out. In the test, the fuel was methane, the temperature of premixed gas injected was 240° C., the air ratio in the combustion chamber 1.0 to 1.1, and only the premixed gas consisting of combustion air and the fuel was fed.

Figure 13:
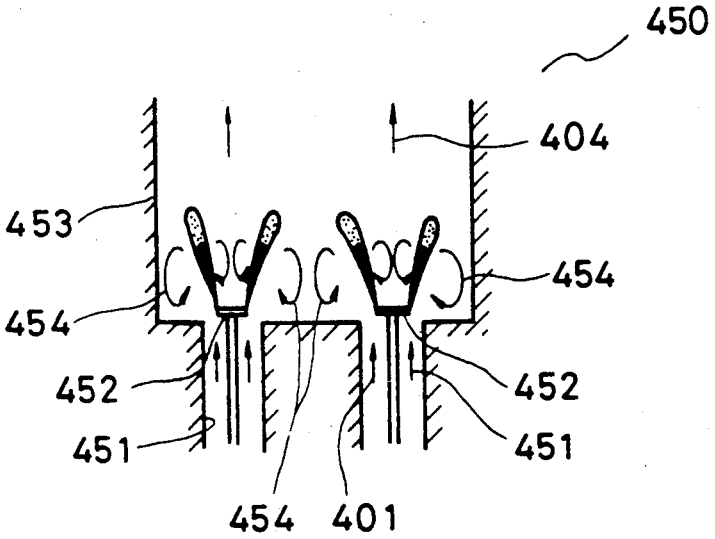
FIG. 13 is partial diagrammatical sectional view of the fifth test combustor.

A fifth test combustor 450 is illustrated in FIG. 13, including a plurality of premix flame forming nozzles 451, 451, . . . each having an exhaust port arranged in a circle. Each of the premix flame forming nozzles 451 is provided close to its exhaust port with a disc shaped 452 of which stem extends through it. A combustion chamber 453 is communicated at its upstream end to the premix flame forming nozzles 451. The overall cross-sectional are of the path of the premixed gas 401 sharply increased at the upstream end of the combustion chamber 453. In the fifth test combustor 450, baffles 452 are provided to correspond to respective premix flame forming nozzles 451, 451, . . . . With such an arrangement, premixed gas 401 being ejected from the premix flame forming nozzles 451, 451, . . . is mixed with burnt gas 404 in the an outer recirculating zone 454, and thereby NOx is reduced.

Figure 14:
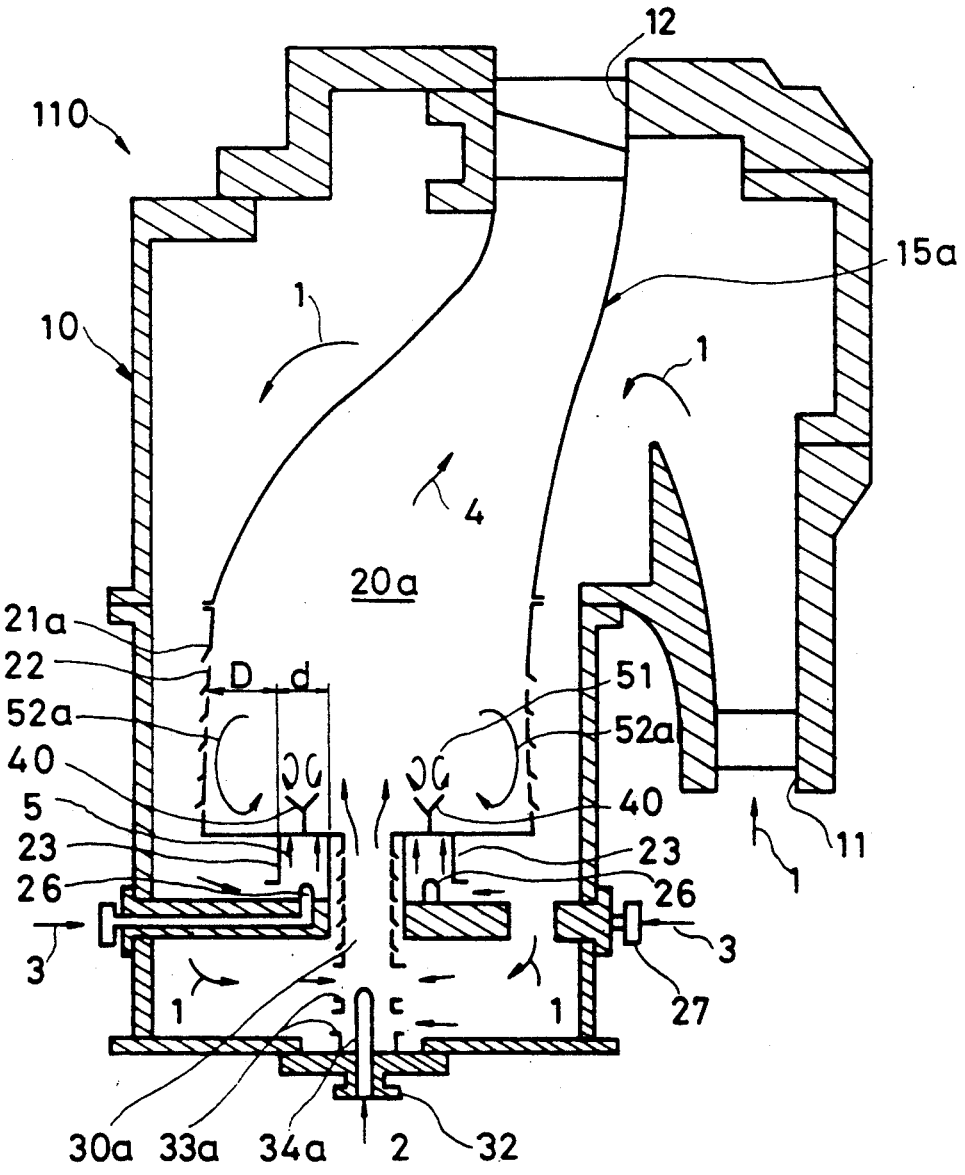
FIG. 14 is an overall sectional view of a gas turbine combustor according to a second embodiment of the present invention.
Figure 15:
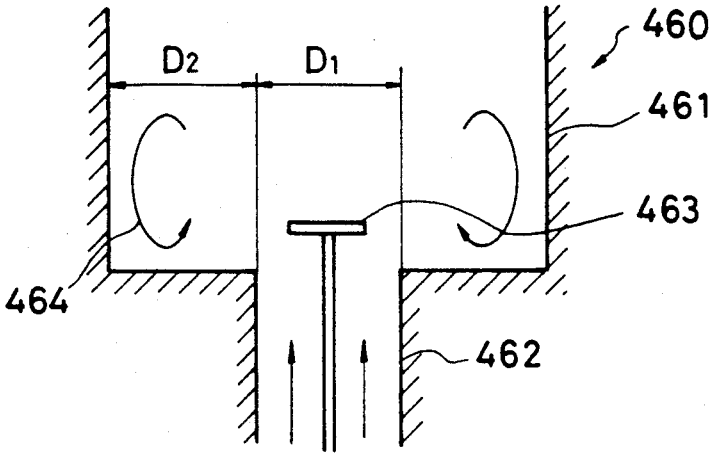
FIG. 15 is a partial diagrammatical sectional view of another test combustor.

A gas turbine combustor of the present invention is illustrated with reference to FIG. 14. The gas turbine combustor 110 is provided with a primary combustion chamber 30*a* to form a diffusion flame, and a secondary combustion chamber 20*a* to form a premix flame. The gas turbine combustor 110 is essentially the same in construction as the gas turbine combustor 100 already described but the path of the premixed gas is sharply widened by a radial length D at the upstream end of the secondary combustion chamber 20*a*. The radial length D is set about 1.5 times the width d of the exhaust port of each premix flame forming nozzle 23.

Also this embodiment provides a stable premix flame since a primary recirculating zone 51 of burned gas 4 is formed downstream of the baffle 40 as in the first embodiment.

Moreover, the rapid increment of the diameter of the secondary combustion chamber 20*a* at the exhaust ports of the premix flame forming nozzles 23 enlarges a second recirculating zone 52*a* formed around the outer periphery of the baffle 40, and thereby a mixing ratio of premixed gas 5, ejected from the premix flame forming nozzles 23, and burned gas 4 within the second recirculating zone 52*a* is increased. The premixed gas 5 and the burned gas 4 is mixed to form combustion gas mixture with a low oxygen partial pressure. The amount of combustion gas mixture burnt is larger than the amount of premixed gas 5 burnt singly, and hence NOx is reduced.

Combustion air flows into the secondary combustion chamber 20*a* through cooling air ports 22 thereof but the sharp increment D of the diameter prevents combustion air 1 from directly flowing into the combustion zone, thereby maintaining the combustion temperature not to drop.

The reduction effect of NOx in combustion chambers which form premix flames was tested in cases where combustion chambers are sharply widened at upstream ends thereof communicating to exhaust ports of premix flame forming nozzles. The test results will be described hereinafter.

In the tests, a combustion chamber 460 has provided with a premix flame forming nozzle 462, a combustion chamber 461 to form a premix flame, and a baffle 463.

Figure 16:
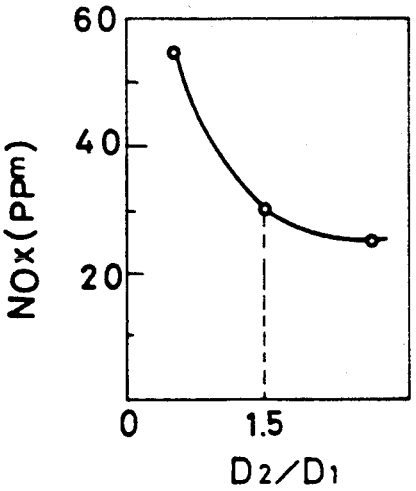
FIG. 16 is a graph illustrating a NOx exhaust characteristic of the combustor of FIG. 15.

As plotted in FIG. 16, the production amount of NOx decreased as a ratio of a diameter increment D2 of the combustion chamber 460 over the diameter D1 of the premix flame forming nozzle 462 increased. This is because as diameter D2 increased, it became easier to form a recirculating flow 464 around the premix flame, so that the oxygen partial pressure in the flame became lower. From the test results, it was confirmed that the reduction effect of NOx became smaller when the ratio D2/D1 exceeds about 1.5. In practice, it is preferable to design that the ratio D2/D1 is about 1.5 to reduce the size of the combustor.

Figure 17:
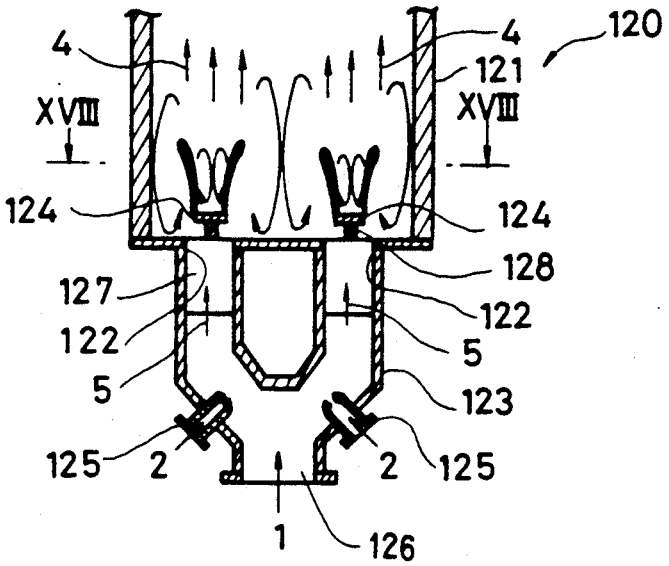
FIG. 17 is a sectional view of an essential portion of the gas turbine combustor of a third embodiment.
Figure 18:
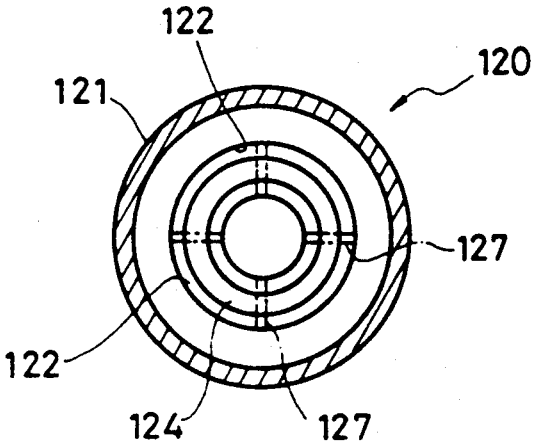
FIG. 18 is a view taken along the line XVIII—XVIII in FIG. 17.

A third embodiment of the present invention is directed to a gas turbine combustor which is generally designated by reference numeral 120 in FIGS. 17 and 18.

The combustor 120 includes a combustor casing 121 which forms premix flames. The combustor casing 121 is communicated at its upstream end to a plurality of premix flame forming nozzles 122, 122, . . . , which are, in turn, connected at their upstream ends to a premixed gas supplying manifold 123 for receiving premixed gas 5. A baffle 124 is provided to the upstream end of the combustor casing 121 along exhaust ports of premix flame forming nozzles 122, 122, . . . .

The premixed gas supplying manifold 123 is provided with fuel nozzles 125, 125, and an air nozzle 126 close to an inlet port thereof. The fuel nozzles 125 and 125 are adapted to suction primary fuel 2 and the air nozzle 126 to take in combustion air 1.

The baffle 124 is in the shape of an annular band and is mounted on partitions 127 through supporting members 128, with the supporting members 128 partitioning adjacent premix flame forming nozzles 122 and 122.

The combustor 120 is a practical model of the fifth test combustor 450. Similarly with the combustors of the first and the second embodiments, the combustor 120 is capable of both providing a stable premix flame and suppressing the generation of NOx. The combustor 120 is provided with only the primary combustion chamber, and its is superior in size to the preceding embodiments although it is inferior in tolerance to load change.

It is not necessary that the baffle 124 has a V-shaped section as in the baffles of the first and the second embodiments. The baffle 124 may have any shape if it is capable of forming a recirculating flow downstream thereof. A band like baffle as in this embodiment may be used. Tests revealed that band like baffles gave little influence to the stability of the flame if baffles were mounted at an inclined angle smaller than about 45° to the upstream end of the combustion chamber.

The baffle is heated to high temperatures, and hence it must be made of a material with a sufficient thermal resistance above 500° C. Such a thermal resistance may be provided by supplying air to water through a baffle of a hollow structure for cooling.

Figure 19:
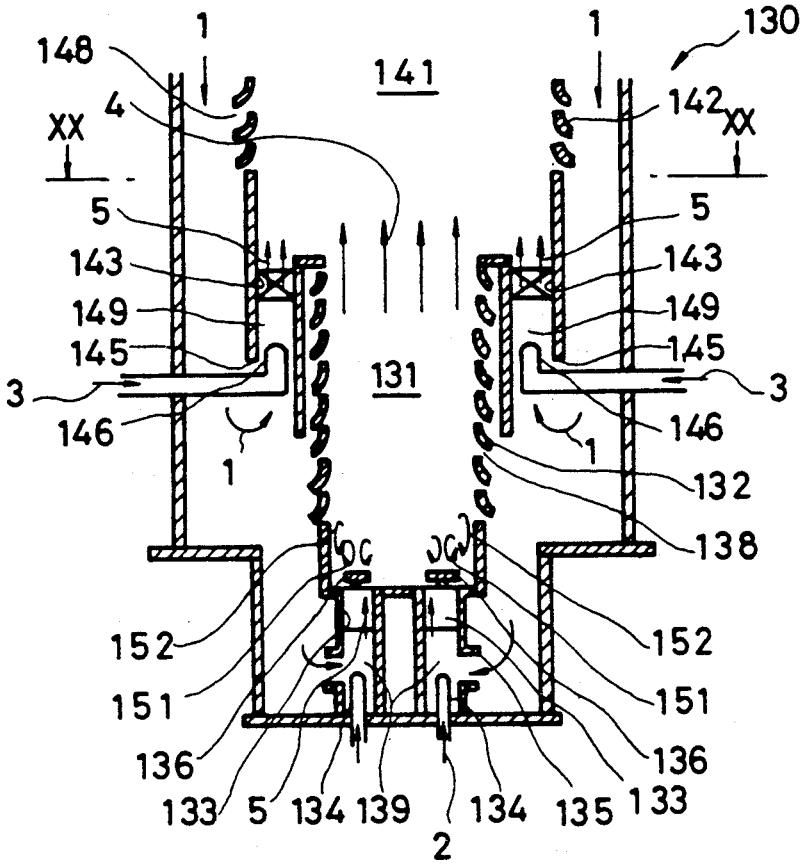
FIG. 19 is a sectional view of an essential portion of the gas turbine combustor of a fourth embodiment.
Figure 20:
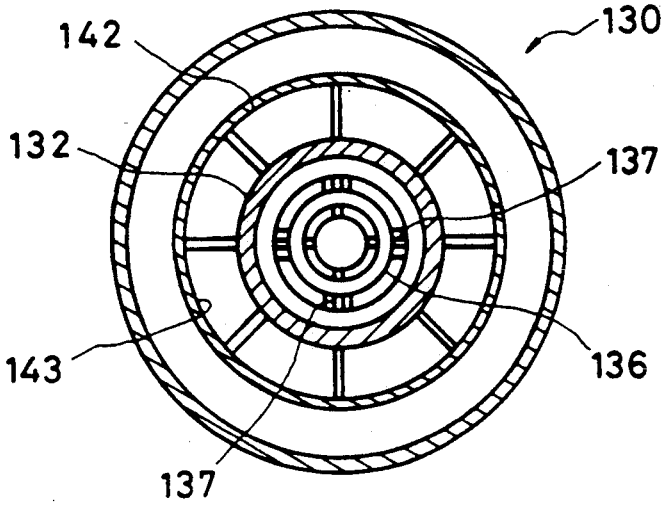
FIG. 20 is a view taken along the line XX—XX in FIG. 19.

Referring to FIGS. 19 and 20, a fourth embodiment of the present invention is directed to a gas turbine combustor which is generally indicated by reference numeral 130.

The gas turbine combustor 130 is provided with two combustion chambers; a primary combustion chamber 131 and a secondary combustion chamber 141. The primary combustion chamber 131 is defined by a primary combustion chamber inner housing 132, of which upstream and is provided with a plurality of primary premix flame forming nozzles 133, 133, . . . to communicate to the primary combustion chamber 131. Each of the primary premix flame forming nozzles 133, 133, . . . communicates at its upstream end to a primary fuel nozzle 134, and a primary air intake port 135 is formed through each primary premix flame forming nozzle 133 to flow combustion air 1 into it. The primary combustion chamber 131 is formed so that the cross-sectional area of the path of premixed gas 5 is sharply enlarged as premixed gas 5 passes through exhaust ports of the primary premix flame forming nozzles 133.

In the vicinity of the exhaust ports of primary premix flame forming nozzles 133, there is provided a ring-shaped baffle 136 to recirculate burned gas 4 which is generated by combustion of premixed gas 5. The baffle 136 is mounted on partitions 137, 137, . . . through supporting members, the partitions 137 partitioning adjacent primary premix flame forming nozzles 133 and 133.

A secondary combustion inner housing 142 is provided downstream of the primary combustion chamber inner housing 132 to define secondary combustion chamber 141 in it. A plurality of secondary premix flame forming nozzles 143, 143, . . . are angularly arranged within the upstream of the secondary combustion chamber inner housing 142. The upstream end of each secondary premix flame forming nozzle 143 is open and defines a secondary air intake port 145 to flow combustion air 1 into it. A secondary fuel nozzle 146 is inserted at its distal end into each of the secondary air intake port 145 to inject secondary fuel 3.

The primary combustion chamber inner housing 132 and the secondary combustion inner housing 142 are respectively provided at their circumferential walls with cooling air ports 138 and 148 for cooling.

Combustion air 1 is compressed by the air compressor 301 (FIG. 4) and then flows into the gas turbine combustor 130, where combustion air 1 is mixed with primary fuel 2 in the mixing portions 139 of primary premix flame forming nozzles 133 and combustion air is also mixed with secondary fuel 3 in mixing portions 149 of the secondary premix flame forming nozzle 143. Premixed gas 5 thus formed is injected into the primary combustion chamber 131 and the secondary combustion chamber secondary combustion chamber 141. Part of combustion air 1 flows into the primary combustion chamber 131 through cooling air ports 138 for cooling the primary combustion chamber inner housing 132 while another part of combustion air 1 is supplied to secondary combustion chamber 141 through cooling air ports 148 for cooling the the secondary combustion inner housing 142.

Premixed gas 5 which is ejected from the primary premix flame forming nozzles 133 is bifurcated by the baffle 136.

A first recirculating zone 151 is formed downstream of the baffle 136, and premix flames are formed around the first recirculating zone 151. A second recirculating zone 152 is created by burned gas 4 around the premix flames. In the premix flames, combustion gas mixture which is formed by mixing burned gas 4 and premixed gas 5 burns and hence NOx is reduced.

Burnt gas 4 formed in the primary combustion chamber 131 goes substantially linearly into the central portion of the secondary combustion chamber 141. Premixed gas 5 is injected around the burned gas 4, flowing into the secondary combustion chamber 141, from the secondary premix flame forming nozzles 143. Premixed gas 5 which has been ejected from the secondary premix flame forming nozzles 143 is ignited by burned gas 4 produced in the primary combustion chamber 131 to form premix flames.

The provision of two combustion chambers as in this embodiment enlarges a tolerance to load variation.

Figure 21:
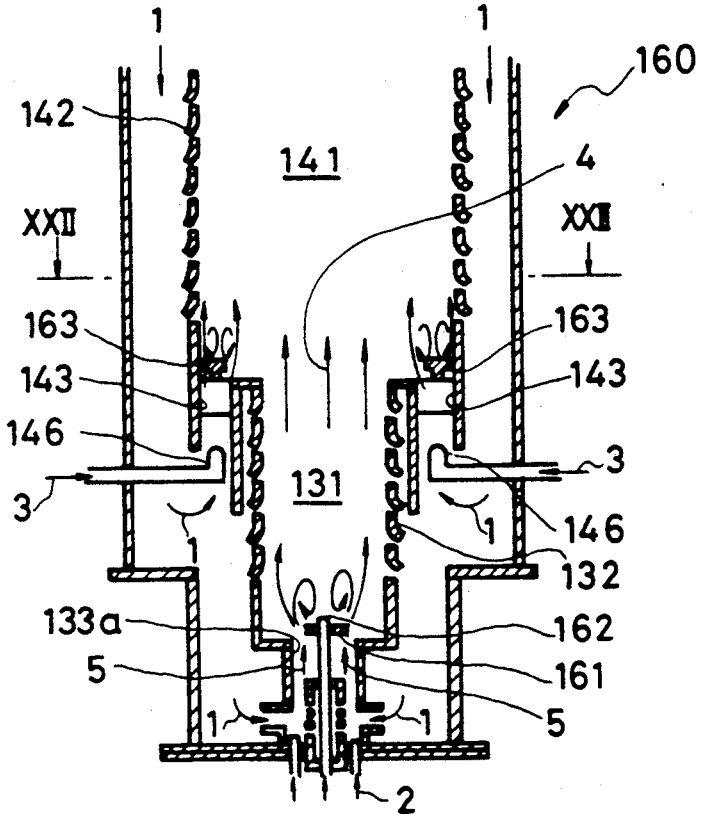
FIG. 21 is a sectional view of an essential portion of the gas turbine combustor of a fifth embodiment.
Figure 22:
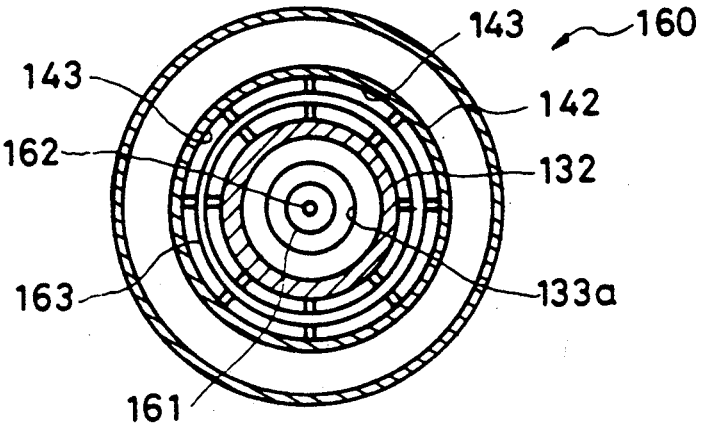
FIG. 22 is a view taken along the line XXII—XXII in FIG. 21.

Referring now to FIGS. 21 and 22, a gas turbine combustor is generally indicated by reference numeral 160 and includes two combustion chambers, a primary combustion chamber 131 and a secondary combustion chamber 141, for forming premix flames. The primary combustion chamber 131 is provided in the vicinity of an exhaust port of a premix flame forming nozzle 133*a* with a baffle 161 while the secondary combustion chamber 141 has a baffle 163 mounted close to exhaust ports of the secondary premix flame forming nozzles 143. The gas turbine combustor 160 is essentially the same in the other structure as the gas turbine combustor 130 of the fourth embodiment. The baffle 161 has a pilot burner 162 arranged downstream of it to form a pilot flame.

To ignite the gas turbine combustor 160, fuel is supplied only to the pilot burner 162 to form a pilot flame downstream of the baffle 161.

After the pilot flame is formed, supplying of primary fuel 2 is started through premix flame forming nozzle 133*a*, thereby forming a premix flame. After the premix flame is stably formed, the supply of the fuel to the pilot burner 162 is stopped. In this manner, the ignition of the gas turbine combustor 160 is easily achieved.

In this embodiment, each of the premix flame forming nozzle 133*a* and the secondary premix flame forming nozzles 143 is provided with the baffle 161 or 163, and hence the premix flame thereof does not largely depend upon the supply of the fuel, so that stable premix flames are always provided.

Figure 23:
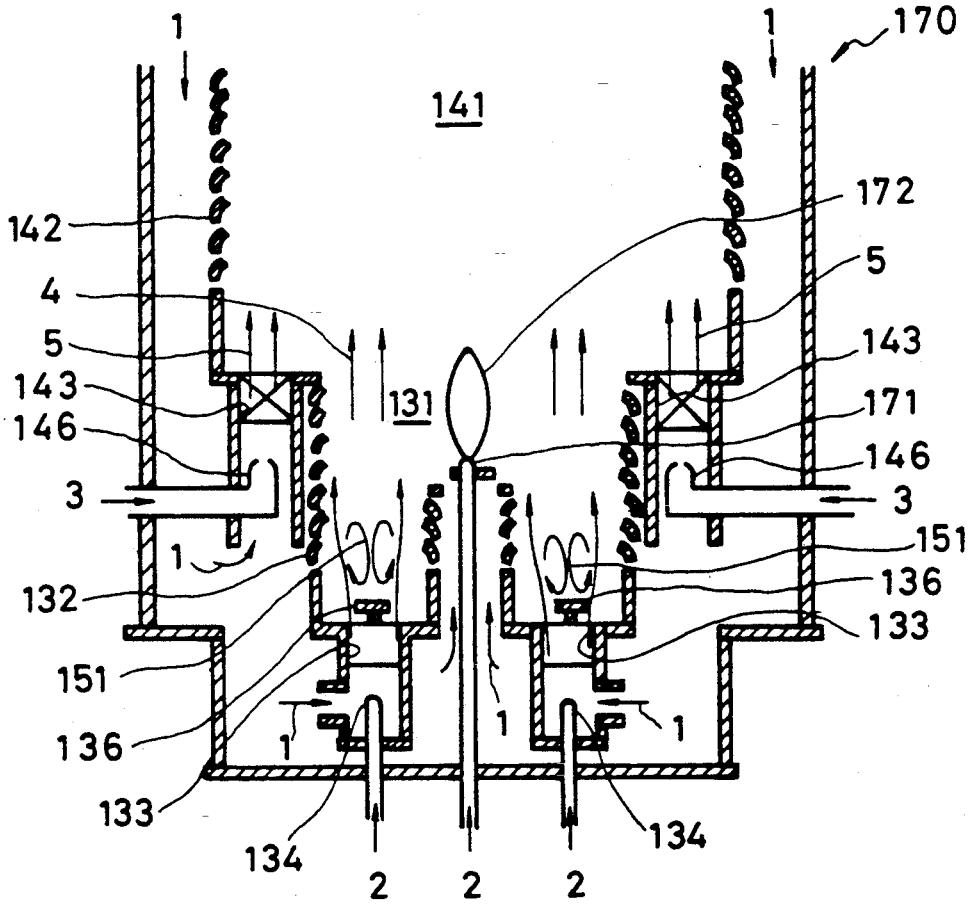
FIG. 23 is a sectional view of an essential portion of the gas turbine combustor of a sixth embodiment.

As shown in FIG. 23, a gas turbine combustor 23. The gas turbine combustor of the present invention is generally indicated by reference numeral 170. is built by arranging primary premix flame forming nozzles 133 to form premix flames within a primary combustion chamber 131 of the gas turbine combustor 130 of the fourth embodiment. A diffusion flame forming nozzle 171, forming a diffusion flame 172, is also provided at the combustor 170. The other general structure of the combustor 170 is substantially the same as the gas turbine combustor 130.

To ignite the combustor 170, primary fuel 2 is ejected from the diffusion flame forming nozzle 171 to form a diffusion flame 172 in the primary combustion chamber 131. After forming the diffusion flame 172, primary fuel 2 is fed to the primary premix flame forming nozzles 133, thereby forming primary premix flames. When the load of the primary combustion chamber 131 reaches a predetermined value, secondary fuel 3 is supplied to secondary premix flame forming nozzles 143 to create secondary premix flames, and the diffusion flame 172 is extinguished. In this event, the secondary premix flames are ignited by burned gas 4 generated by the primary premix flames. Thereafter, the load of each of the primary and secondary premix flames is adjusted to respond to change of the load of the combustor 170.

In this embodiment, ignition of the combustor 170 is easily made. Combustion air 1 to form the diffusion flame 172 is supplied around the diffusion flame forming nozzle 171. The combustion air 1 mixes with combustion gas being discharged from the primary premix flames and hence the diffusion flame 172 produces a small amount of NOx.

Figure 24:
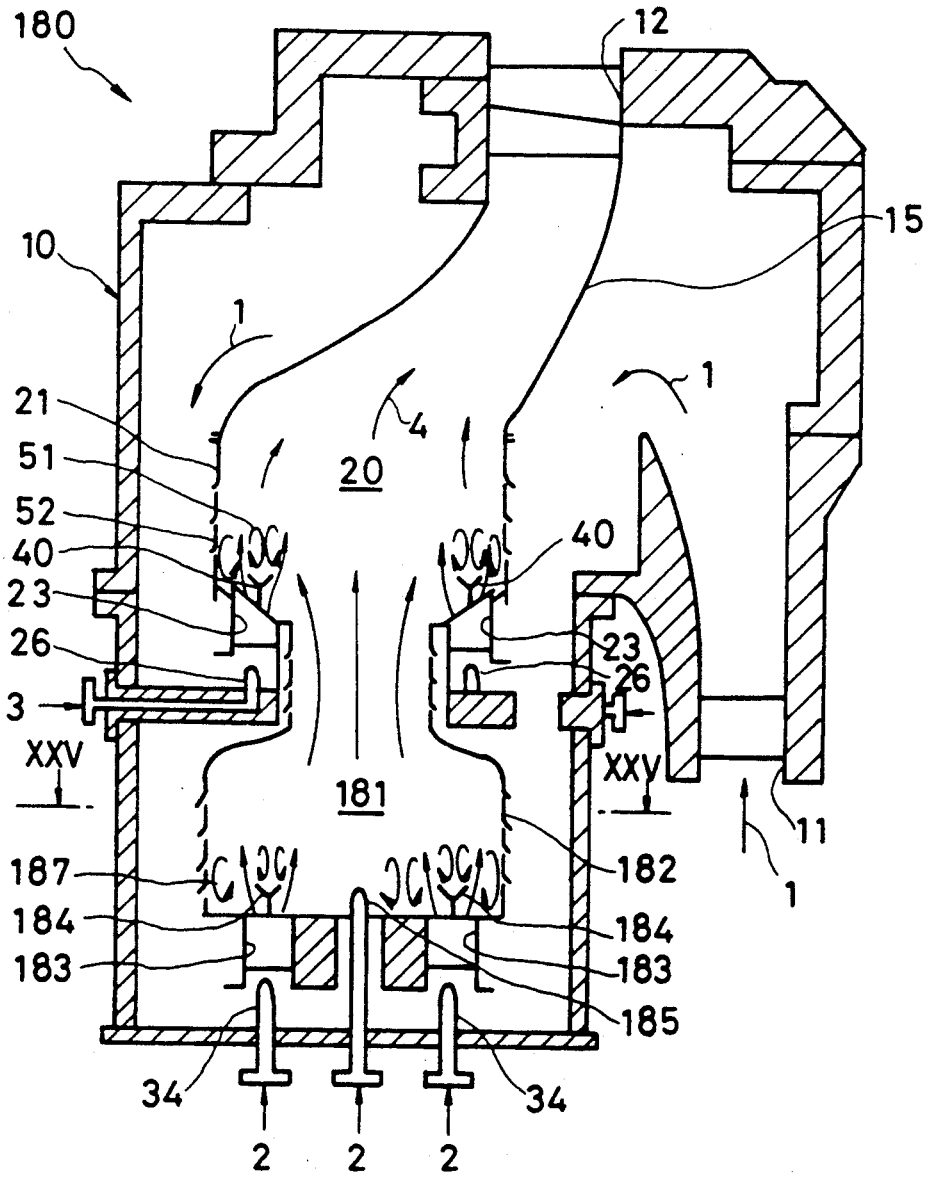
FIG. 24 is a sectional view of the gas turbine combustor of a seventh embodiment.
Figure 25:
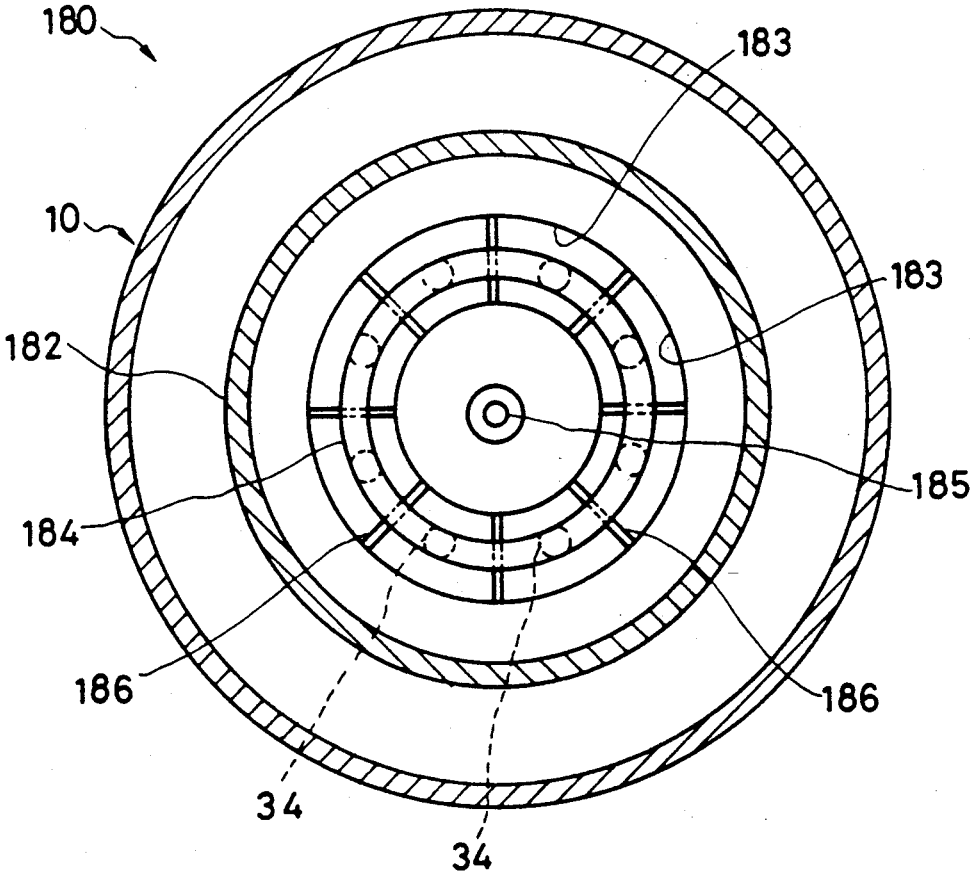
FIG. 25 is a view taken along the line XXV—XXV in FIG. 24.

As shown in FIGS. 24 and 25, a gas turbine combustor as the seventh embodiment of the generally indicated by reference numeral 180 includes, is a primary combustion chamber 181 is communicated at its upstream end with a plurality of primary premix flame forming nozzles 183, 183, . . . , and a baffle 184 is arranged close to exhaust ports of the primary premix flame forming nozzles 183, 183, . . . . A pilot burner 185, forming form, a pilot flame is centrally arranged in the upstream end of the primary combustion chamber 181. A secondary combustion chamber 20 and other essential construction are substantially the same as the gas turbine combustor 100 of the first embodiment.

The primary premix flame forming nozzles 183 and 183, . . . are partitioned by partitions 186, and the primary premix flame forming nozzles 183 are annularly arranged. The baffle 184 has a V-shaped section and is arranged along the primary premix flame forming nozzles 183 downstream of them.

The primary combustion chamber 181 is defined by the primary combustion inner housing 182, and the radial cross-sectional area of the path of the primary premixed gas is sharply enlarged after the premixed gas passes through exhaust ports of the primary premix flame forming nozzles 183.

To actuate the combustor 180, a pilot frame is formed within the primary combustion chamber 181 by a pilot burner 185. Then premix flames are formed within the primary combustion chamber 181. When the combustor 180 reaches a predetermined load, premix flames area created within the secondary combustion chamber 20. The pilot burner 185 facilitates ignition of the combustor 180.

In this embodiment, the primary combustion chamber 181 and the secondary combustion chamber 20 are provided with baffles 183 and 40 at exhaust ports of their nozzles 183 and 23, respectively, and hence stable premix flames are provided. The sharp increases of the cross-sectional area of the path of premixed gas at exhaust ports of the premix flame forming nozzles 23 and 183 produce recirculating zone 52 and recirculating zone 187 of burned gas 4 around respective premix flames, and thereby the production of NOx is suppressed.

Figure 26:
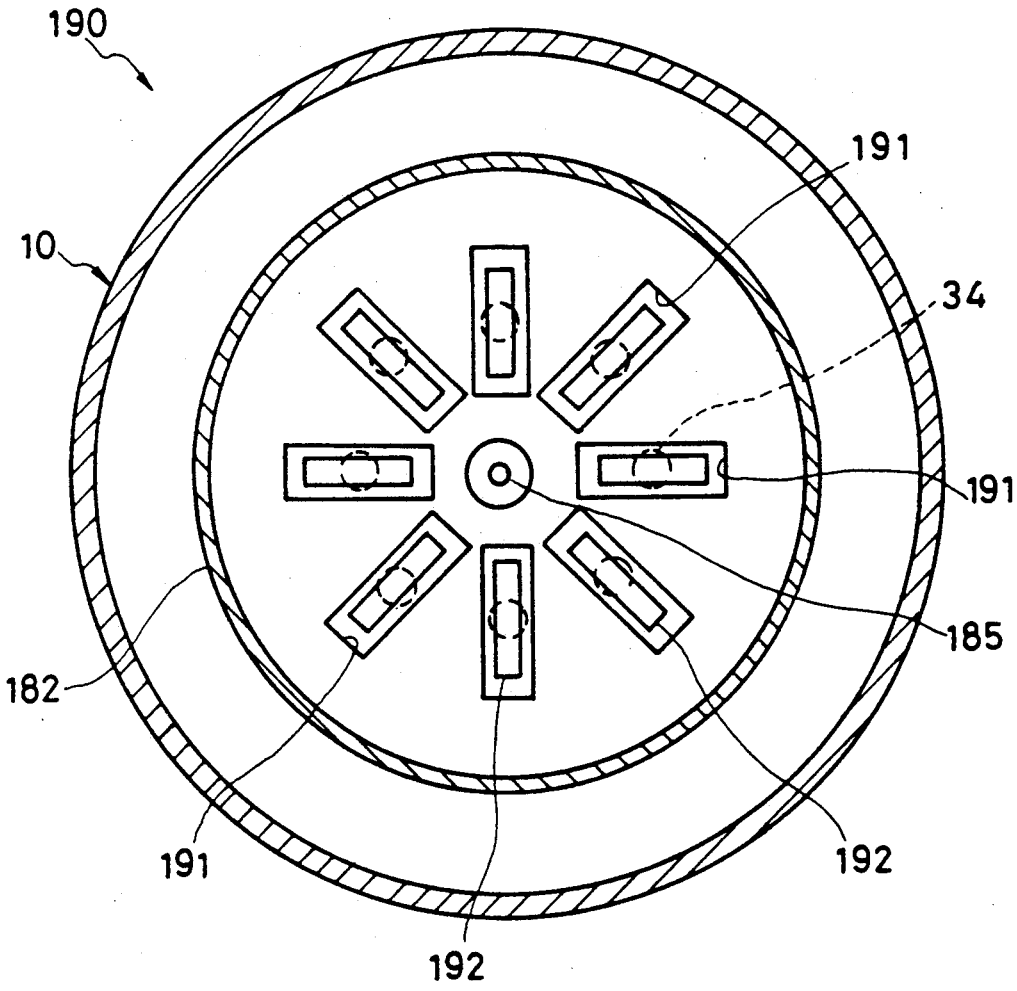
FIG. 26 is a sectional view of an essential portion of the gas turbine combustor of a seventh embodiment.

When a plurality of premix flame forming nozzles are provided, in the preceding embodiments they are continuously arranged in the shape of a ring. However, premix flame forming nozzles are not restricted to such an arrangement but they may be, as shown in FIG. 26, arranged radially outwardly at equal angular intervals about the axis of the combustor 190. In this case, a plurality of baffles 192, 192, . . . which stabilize flames are, preferably, arranged radially outwardly to correspond to respective premix flame forming nozzles 191. The combustor 190 is a modified form of the seventh embodiment.

Figure 27:
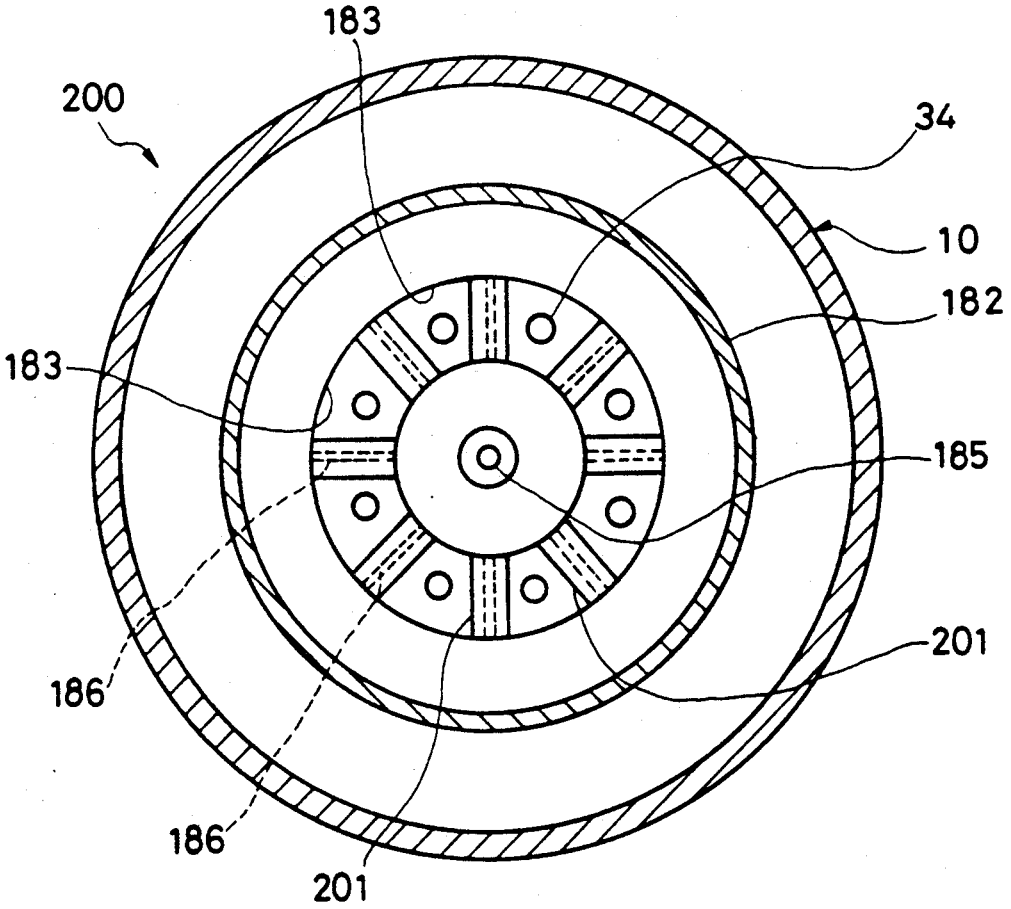
FIG. 27 is a sectional view of an essential portion of a modified form of the gas turbine combustor of a seventh embodiment.

As illustrated in a combustor 200 of FIG. 27, separate baffles 201 may also be mounted on respective partitions 186 which partition adjacent premix flame forming nozzles 183. The combustor 200 is a modification of the combustor of FIG. 24.

Figure 28:
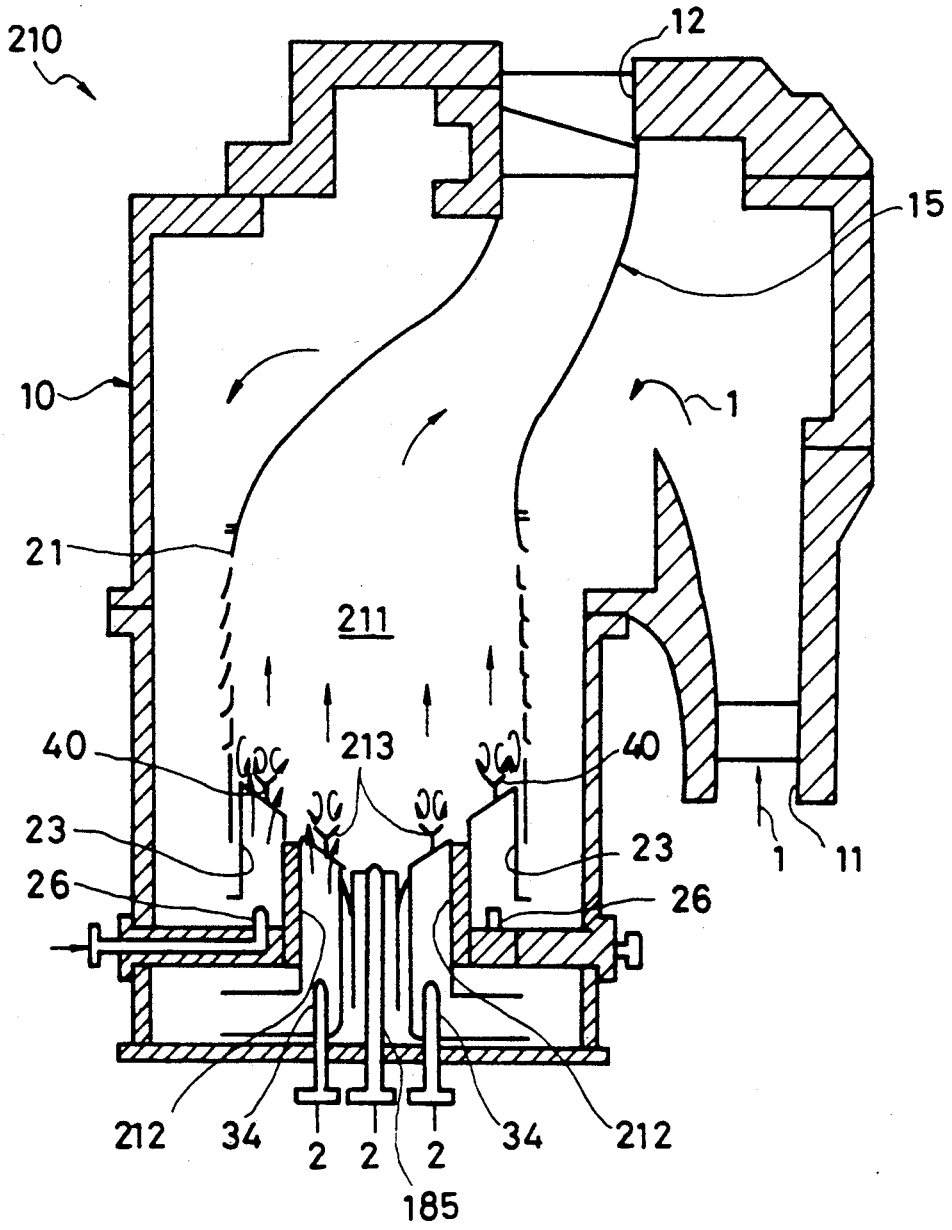
FIG. 28 is a sectional view of a gas turbine combustor of a eighth embodiment.

An eighth embodiment of the present invention is directed to a gas turbine combustor illustrated in FIG. 28 in which the gas turbine combustor is generally designated by reference numeral 210.

In the combustor 210, a plurality of primary premix flame forming nozzles 212, 212, . . . are annularly arranged in an upstream of a combustion chamber 211 to form a group of a primary premix flame forming nozzles, around which a plurality of premix flame forming nozzles 23, 23, . . . are also annularly provided to form a group of secondary premix flame forming nozzles. A pilot burner 185 is provided at the center of the upstream end of the combustion chamber 211 to form a premix flame.

In the vicinity of exhaust ports of the primary premix flame forming nozzles 212 and premix flame forming nozzles 23 there are provided a baffle 213 and a baffle 40, respectively.

The combustor 210 enables stable premix flames to be formed and NOx to be fairly reduced. In this embodiment, the primary and secondary premix flames are formed within the same combustor 211. To prevent both the reduction effect of NOx from deteriorating and oscillating combustion from taking place due to overlapping of flames as in the fourth test combustor 440, it is necessary to pay sufficient attention to the positional relationship between the primary premix flame forming nozzles 212 and the premix flame forming nozzles 23 in designing the combustor 210.

Figure 29:
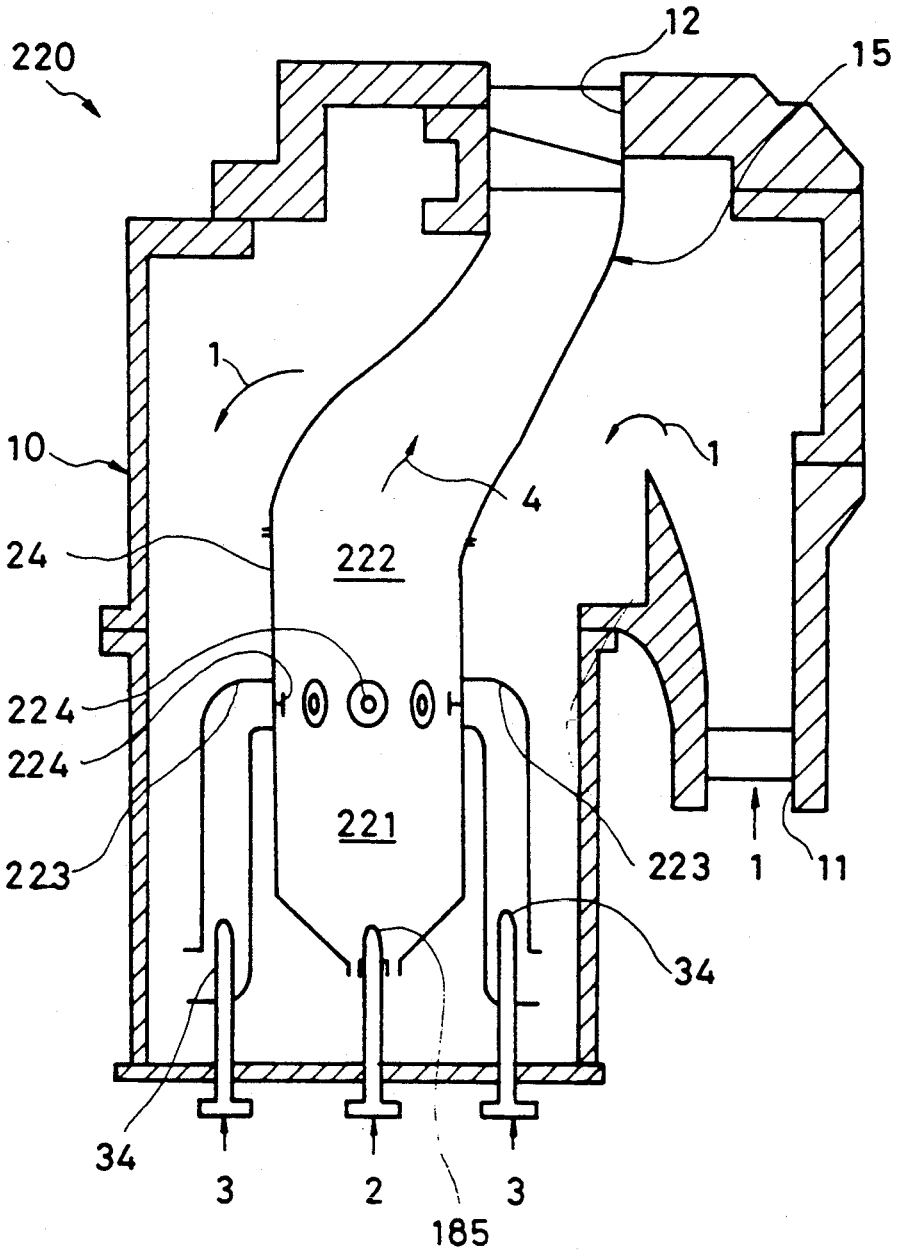
FIG. 29 is a sectional view of a gas turbine combustor of a ninth embodiment.

A gas turbine combustor as the ninth embodiment of the present invention will be described with reference to FIG. 29, in which the gas turbine combustor is generally designated by reference numeral 220.

In the combustor 220, diffusion flames are formed in a primary combustion chamber 221 while premix flames are produced in a secondary combustion chamber 222. A plurality of premix flame forming nozzles 223, 223, . . . are disposed on the circumferential walls of the secondary combustion inner housing 24.

The premix flame forming nozzles 223, 223, . . . are arranged in such a manner that premixed gas is ejected from them the nozzles toward the axis of the inner housing 24. In the vicinity of each premix flame forming nozzles 223 there is provided a baffle 224.

Also in the combustor 220, recirculating zones are formed around the center axis of the secondary combustion inner housing 24 to correspond to respective baffles 224, and recirculating zones are further formed around diffusion flames. Thus, stabilized premix flames are obtained and NOx is reduced.

Figure 30:
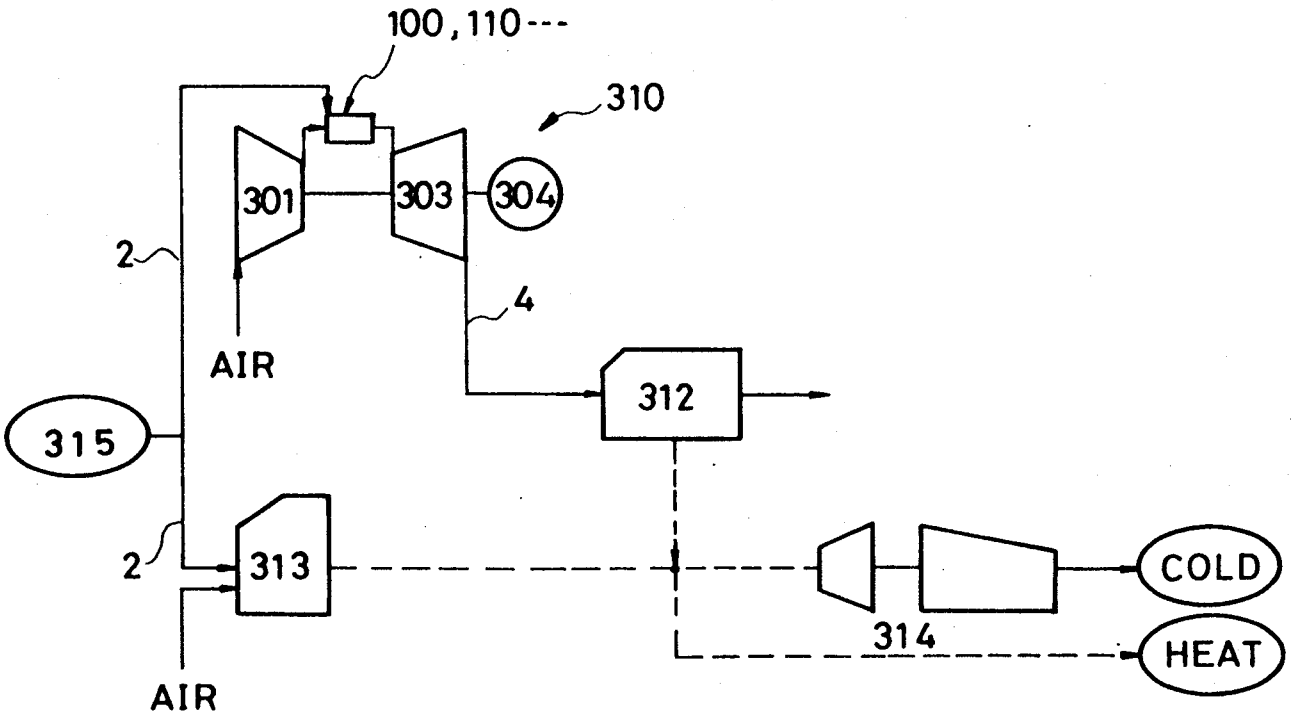
FIG. 30 is a schematic flow diagram of a cogeneration system.

The combustors 100, 110, . . . of the preceding embodiments may, as shown in FIG. 30, constitute a cogeneration system by providing a exhaust heat recovery boiler 312, which generates steam by heat of burned gas 4 from gas turbine 303, as well as a gas turbine 303. The cogeneration system includes a gas turbine generating plant 310 which includes an air compressor 301, gas turbine combustor 100, 110, . . . , the gas turbine 303 and a generator 304. The cogeneration system further includes a main boiler 313, a fuel supply system 315, a exhaust heat a recovery boiler 312 and a turbo-cooler 314, the fuel supply system 315 being connected to both the combustors 100, 110, . . . and a main boiler 313 for feeding primary fuel 2.

Fuel 2 is supplied to the gas turbine combustor 100, 110, . . . and burns in it, and then burned gas 4 which has been generated by the combustion is sent to the gas turbine 303 where it drives the gas turbine to generate an electric power. The burned gas 4 from the gas turbine 303 is sent to the exhaust heat recovery boiler 312 where steam is generated. The steam may be used for driving the the turbo-cooler 314 in the summer and for heating in the winter. When the steam is insufficient, then steam generated in the main boiler 313 may be used.

Such a cogeneration system is often installed in cities and the suburbs where NOx emission standards are strict. The combustor of the present invention can reach strict standards without providing any denitration equipment within the exhaust heat recovery boiler 312 since the exhaust amount of NOx in the gas turbine combustor is fairly small.

An exhaust heat recovering type combined cycle may be constructed by connecting a steam turbine to the exhaust heat recovering boiler 312.

The preceding embodiments mainly relate to gas turbine combustors, but the present invention is not limited to them. The present invention may be applied to various combustors which generate thermal NOx by combustion of fuel, and the combustor may include, for example, a boiler, denitration equipment and reactor in chemical plants.

Figure 31:
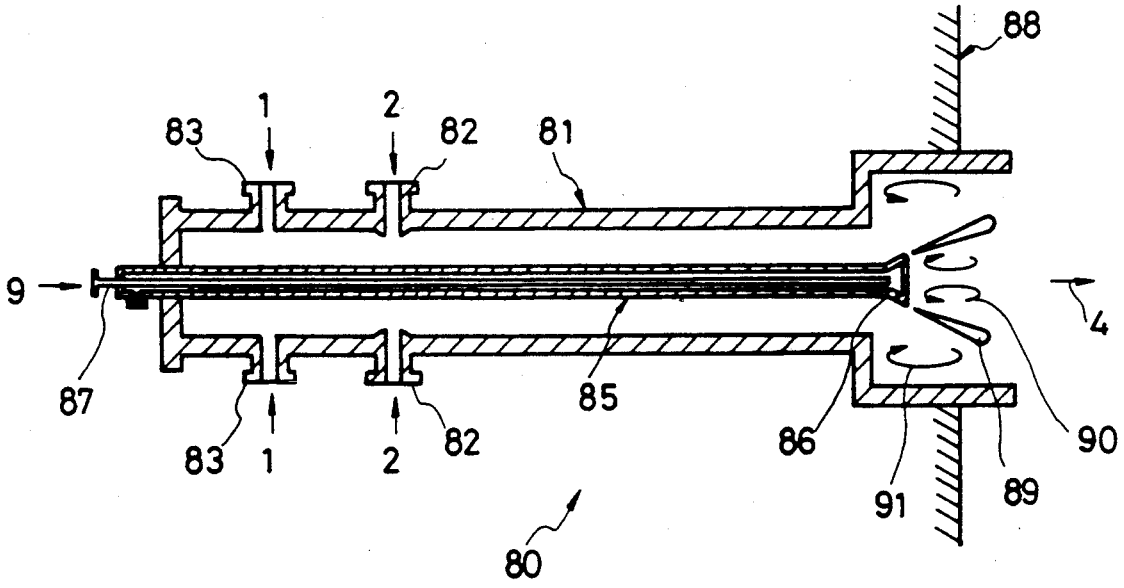
FIG. 31 is an axial cross-section of a burner of the present invention.

A burner 80 of another embodiment of the present invention will be described with reference to FIG. 31. The burner 80 is provided with an outer housing 81 and an inner sleeve 85. The diameter of a downstream portion of the outer housing 81 is sharply enlarged. The outer housing 81 is provided in its upstream portion with fuel nozzles 82 to feed primary fuel 2 and air nozzles 3 to supply combustion air 1. In the vicinity of the downstream end of the inner sleeve 85, there is provided a baffle 86 which is designed to form a recirculating flow downstream thereof. The inner sleeve 85 has a hollow structure and is provided with a cooling water supply tube 87 to supply cooling water 9 in it.

When such a burner 80 is mounted to a combustor 88 and premix flames 89 are formed, a first recirculating zone 90 is, as in the gas turbine combustors previously described, formed of burned gas 4 downstream of the baffle 86, and a second circulating zone 91 of burned gas 4 is produced around the premix flames 89. Thus, stable premix flames 89 are obtained and NOx is reduced.

What is claimed is:

1. A combustor comprising:

a combustion chamber;

at least one nozzle for ejecting a jet of a premixed gas containing fuel and air through an exhaust port thereof;

baffle means arranged in a vicinity of the exhaust port of the nozzle and downstream of an end of the exhaust port for baffling the jet of the premixed gas so as to form a circulating flow downstream thereof, wherein said combustion chamber has a cross-sectional area enlarging from that of the end of the exhaust port of the nozzle, and wherein the baffle means is smaller than an opening area of the exhaust port of the nozzle.

2. A combustor as recited in claim 1, further comprising cooling means for cooling the baffle means.

3. A combustor as recited in claim 1, wherein a plurality of nozzles are provided and are arranged along a common circumference.

4. A combustor as recited in claim 1, further comprising a second nozzle for forming one of a premixed flame and a diffusion flame at one of upstream or downstream positions of the first nozzle.

5. A combustor comprising:

a nozzle including an exhaust port, the nozzle ejecting an annular jet of a premixed gas containing fuel and air through the exhaust port;

recirculating flow forming means arranged in a vicinity of the exhaust port of the nozzle for bifurcating a flame of the annular jet into two concentric annular flames at a bifurcating position, thereby forming a recirculating flow of a burned gas, produced by combustion of the premixed gas, downstream of the bifurcating position; and burned gas mixing means for mixing the burned gas into the premixed gas outwardly of the bifurcated premixed gas.

6. A combustor as recited in claim 5, further comprising:

a combustion chamber communicating with the exhaust port of the nozzle; and means for sharply enlarging a cross-sectional area of the combustion chamber from the exhaust port of the nozzle, the cross section being taken substantially perpendicularly to the jet of the premixed gas.

7. A combustor comprising:

a plurality of combustion chambers;

a nozzle arranged within at least one of the combustion chambers for ejecting a jet of a premixed gas containing fuel and air to form a premix flame;

first recirculating flow forming means for forming a first recirculating flow of a first burned gas within the premix flame, the first burned gas being produced from the premix flame;

second recirculating flow forming means for forming the second recirculating flow of the first burned gas outside the premix flame; and burning gas mixing means for mixing a second burned gas into the premixed flame, the second burned gas being produced in another of said plurality of combustion chambers.

8. A combustor comprising:

a first combustion chamber for forming a predetermined flame;

a second combustion chamber for burning a premixed gas containing fuel and air;

a nozzle for ejecting the premixed gas through an exhaust port thereof;

baffle means arranged in a vicinity of the exhaust port of the nozzle and downstream of an end of the exhaust port for baffling the jet of the premixed gas so as to form a circulating flow downstream thereof; and means for mixing a burned gas produced in the first combustion chamber into the premixed gas, and wherein said second combustion chamber has a cross-sectional area sharply enlarging from that of the end of the exhaust port of the nozzle.

9. A combustor as recited in claim 8, wherein the predetermined flame formed in the first combustion chamber comprises a premix flame and a pilot flame.

10. A combustor as recited in claim 8, wherein the predetermined flame formed in the first combustion chamber is of a diffusion flame.

11. A combustor as recited in claim 8, wherein the predetermined flame formed in the first combustion chamber is of a premix flame.

12. A combustor as recited in one of claims 8 or 14, wherein the nozzle is an annularly shaped nozzle.

13. A combustor as recited in claim 12, wherein the annularly shaped nozzle comprises a plurality of partitions for radially partitioning the nozzle for form separate subnozzles each having an exhaust subport.

14. A combustor as recited in one of claims 8 or 10, wherein the first combustion chamber is arranged upstream of the second combustion chamber.

15. A gas turbine combustor using a combustor as recited in one of claims 1, 5, 7, 8 or 10, further comprising a burned gas exhausting means for exhausting the burned gas to a gas turbine.

16. A combustor comprising:

a first combustion chamber for forming a predetermined flame;

a second combustion chamber, communicated with the first combustion chamber, for forming a premix flame;

an annular nozzle, having an exhaust port, for injecting the premixed gas into the second combustion chamber through the exhaust port, the nozzle comprising a plurality of partitions for radially partitioning the nozzle for forming separate subnozzles each having an exhaust subport;

baffle means for baffling a jet of the premixed gas injected into the second combustion chamber so that a recirculating flow of a first burned gas is formed downstream of the jet, the first burned gas generated by combustion of the premixed gas, the baffle means has an annular shape and is arranged along each subnozzle downstream of the exhaust subport thereof; and burned gas mixing means for mixing both the first burned gas and a second burned gas into the premix flame, the second burned gas being produced in the first combustion chamber.

17. A combustor as recited in claim 16, wherein an area of a cross section of the baffle means is smaller than an area of the exhaust port of the annular nozzle, the cross section being taken in a direction substantially perpendicularly to a flow direction of the premixed gas ejected from the annular nozzle.

18. A combustor according to claim 16, wherein a projection area taken in a downstream direction of the baffle means, is smaller than an opening area of the exhaust port of the nozzle.

19. A combustor comprising:

a first combustion chamber for forming a predetermined flame;

a second combustion chamber, communicating with the first combustion chamber, for forming a premix flame;

an annular nozzle, having an exhaust port, for injecting a premixed gas into the second combustion chamber through the exhaust port;

baffle means for baffling a jet of the premixed gas injected into the second combustion chamber so that a recirculating flow of a first burned gas is formed downstream of the jet, the first burned gas being generated by combustion of the premixed gas, the baffle means has an annular shape and is arranged downstream of the exhaust port of the annular nozzle; and burned gas mixing means for mixing both the first burned gas and a second burned gas into the premix flame, the second burned gas produced in the first combustion chamber.

20. A combustor according to one of claims 16 or 19, wherein the predetermined flame formed in the first combustion chamber is a diffusion flame.

21. A gas turbine combustor comprising:

a first annular nozzle, having an exhaust port, for ejecting an annular jet of a first premixed gas through the exhaust port, the first premixed gas containing primary fuel and air;

annular baffle means for baffling the annular first premixed gas jet to bifurcate the first premixed gas jet into two concentric annular jets;

a primary combustion chamber in communication with the exhaust port of the first nozzle, the primary combustion chamber sharply enlarging a cross-sectional area thereof from the exhaust port of the first annular nozzle;

a second annular nozzle including an exhaust port for ejecting an annular jet of a secondary premixed gas, through the exhaust port thereof, the second annular nozzle being arranged downstream of the primary combustion chamber and having an inner diameter larger than an outer diameter of the first annular nozzle, the secondary premixed gas containing secondary fuel and air; and a secondary combustion chamber adapted to receive the secondary premixed gas injected therein from the second annular nozzle.

22. A gas turbine combustor as recited in claim 21, further comprising:

baffle means for baffling an annular jet of the secondary premixed gas to bifurcate a jet of the secondary premixed gas into two concentric annular bifurcated jets.

23. A gas turbine combustor as recited in one of claims 21 or 22, wherein the secondary combustion chamber sharply enlarges in cross-sectional area from the exhaust port of the second annular nozzle, the cross section being taken substantially perpendicularly to the jet of the secondary premixed gas.

24. A gas turbine combustion as recited in one of claims 21 or 22, wherein the primary combustion chamber includes an upstream end, further comprising a pilot burner arranged at the upstream end of the primary combustion chamber.

25. A gas turbine combustor comprising:

a primary combustion chamber for forming a diffusion flame;

an annular nozzle including an exhaust port for ejecting an annular jet of a premixed gas, the premixed gas containing fuel and air, the annular nozzle being disposed downstream of the primary combustion chamber;

annular baffle means for baffling the annular jet of the premixed gas to bifurcate the premixed gas jet into two concentric bifurcated jets of the premixed gas; and a second combustion chamber sharply enlarging in cross-sectional area from the exhaust port of the annular nozzle, the cross section being taken substantially perpendicularly to the jet of the premixed gas.

26. A gas turbine power generation arrangement, the arrangement comprising:

a gas turbine combustor as recited in claim 28;

a gas turbine in communication with the gas turbine combustor to receive a burned gas from the gas turbine combustor for driving the gas turbine, the burned gas being produced in the gas turbine combustion; and a generator operatively connected to the gas turbine for driving the generator to generate electric power.

27. A cogeneration system comprising:

a gas turbine combustor as recited in claim 25;

a gas turbine in communication with the gas turbine combustor to receive a burned gas from the gas turbine combustor for driving the gas turbine, the burned gas being produced in the gas turbine combustor;

a generator operatively connected to the gas turbine for driving the generator to generate electric power; and an exhaust heat recovery boiler in communication with the gas turbine for receiving the burned gas exhausted from the gas turbine and adapted to generate steam by heat exchange with the burned gas.

28. A burner having an exhaust port for ejecting a jet of pressurized gas containing fuel and air, comprising:

baffle means arranged in a vicinity of the exhaust port downstream of an end of the exhaust port of the nozzle for baffling the jet of the premixed gas so as to form a circulating flow downstream thereof; and space defining means formed downstream of the end of the exhaust port for defining a space sharply enlarging from the exhaust port, and wherein the baffle means is smaller than an opening are of the exhaust port.

29. A combustor having a burner as recited in claim 28 mounted thereto.

30. A combustor comprising:

a combustion chamber for burning a premixed gas containing fuel and air;

a nozzle for ejecting an annular jet of the premixed gas through an exhaust port thereof;

baffle means, arranged in a vicinity of an exhaust port of the nozzle and downstream of an end of the exhaust port of the nozzle, for bifurcating the annular jet of the premixed gas into two concentric annular flames at a bifurcating position so as to form a circulating flow of a burned gas, produced by the combustion of the premixed gas, downstream of the bifurcating position, and wherein said combustion chamber has a cross-sectional area sharply enlarging that of the end of the exhaust port of the nozzle.

31. A combustor comprising:

a plurality of combustion chambers;

a nozzle arranged within a first combustion chamber for ejecting a jet of premixed gas containing fuel and air through an exhaust port thereof so as to form a premixed flame;

baffle means, arranged in a vicinity of the exhaust port of the nozzle and downstream of an end of the exhaust port of the nozzle for baffling the jet of premixed gas so as to form a circulating flow downstream thereof; and means for mixing a burned gas produced by a second combustion chamber of the plurality of combustion chambers other than the first chamber in which the nozzle for ejecting the premixed gas jet is arranged to form the premix flame, into the premix flame, and wherein said first combustion chamber has a cross-sectional area sharply enlarging from that of the end of the exhaust port of the nozzle.

* * * * *